US009278823B2

(12) United States Patent
Fujii et al.

(10) Patent No.: US 9,278,823 B2
(45) Date of Patent: Mar. 8, 2016

(54) SHEET FEEDING DEVICE AND IMAGE FORMING APPARATUS INCORPORATING SAME

(71) Applicants: Ikuo Fujii, Osaka (JP); Ippei Kimura, Osaka (JP); Mizuna Tanaka, Osaka (JP); Hirofumi Horita, Osaka (JP)

(72) Inventors: Ikuo Fujii, Osaka (JP); Ippei Kimura, Osaka (JP); Mizuna Tanaka, Osaka (JP); Hirofumi Horita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/261,591

(22) Filed: Apr. 25, 2014

(65) Prior Publication Data

US 2014/0319759 A1 Oct. 30, 2014

(30) Foreign Application Priority Data

Apr. 30, 2013 (JP) ..... 2013-095598

(51) Int. Cl.

*B65H 1/00* (2006.01)
*B65H 7/04* (2006.01)
*B65H 1/26* (2006.01)

(52) U.S. Cl.

CPC ..... *B65H 7/04* (2013.01); *B65H 1/266* (2013.01); *B65H 2405/1117* (2013.01); *B65H 2511/152* (2013.01); *B65H 2511/212* (2013.01); *B65H 2511/30* (2013.01); *B65H 2551/23* (2013.01); *B65H 2553/61* (2013.01); *B65H 2553/612* (2013.01); *B65H 2553/81* (2013.01)

(58) Field of Classification Search

CPC ..... B65H 7/04; B65H 7/14; B65H 2553/61; B65H 2553/612; B65H 2553/614; B65H 2553/81

See application file for complete search history.

(56) References Cited

U.S. PATENT DOCUMENTS

| | | | | |
|---|---|---|---|---|
| 5,236,348 | A * | 8/1993 | Fetherolf | B41J 11/58 116/303 |
| 7,758,042 | B2 * | 7/2010 | Tomura et al. | 271/162 |
| 2013/0001871 | A1 * | 1/2013 | Chen | B65H 7/02 271/265.01 |
| 2013/0200562 | A1 | 8/2013 | Matsuyama et al. | |

FOREIGN PATENT DOCUMENTS

| | | | |
|---|---|---|---|
| JP | 61211240 | A * | 9/1986 |
| JP | 10-007267 | | 1/1998 |
| JP | 10-297793 | | 11/1998 |
| JP | 2002-003013 | | 1/2002 |
| JP | 2006-219266 | | 8/2006 |
| JP | 2006-347720 | | 12/2006 |

* cited by examiner

*Primary Examiner* — Howard Sanders

(74) *Attorney, Agent, or Firm* — Harness, Dicky & Pierce, P.L.C.

(57) ABSTRACT

A sheet feeding device, which is incorporated in an image forming apparatus, includes a sheet container that contains a sheet therein, an outer end part connectable to the sheet container, a sheet feeding member, a swing shaft, a sheet loading member supported by the swing shaft to swing according to an amount of sheets loaded on the loading surface, a rotary shaft, and a sheet amount indicator being rotatably supported by the rotary shaft and having a contact end contacting the sheet loading member swinging according to a remaining amount of sheets and a sheet amount display end moving in a given display range visible from the outside of the sheet feeding device. The sheet loading member has a sloped surface sloped to a loading surface of the loading member and disposed at a portion where the contact end of the sheet amount indicator contacts the loading surface.

23 Claims, 18 Drawing Sheets

SHEET FEEDING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-095598, filed on Apr. 30, 2013 in the Japan Patent Office, the entire disclosure of which is hereby incorporated by reference herein.

BACKGROUND

1. Technical Field

Embodiments of the present invention relate to a sheet feeding device that feeds sheets, and an image forming apparatus incorporating the sheet feeding device.

2. Related Art

Known sheet feeding devices that are incorporated in an image forming apparatus includes one or more sheet containers to feed a recording media such as a sheet image forming apparatus from a selected sheet container to a sheet conveying path for copying and printing.

Japanese Patent Application Publication No. JP H10-297793-A discloses a sheet loading device that indicates an amount of remaining sheets loaded in a sheet container. The sheet loading device disclosed in JP H10-297793-A includes a sheet loading plate, a biasing member that biases the sheet loading plate to move according to the amount of loaded sheets, and a sheet amount indicator that moves in a vertical direction. The sheet loading plate, the biasing member, and a swing member are provided in a box-shaped container. The sheet amount indicator is provided to extend from a slit formed on a cover member that is detachably attached from a downstream side of the sheet container in a sheet feeding direction. One end of the swing member is in contact with a lower side of a loading surface of the sheet loading plate and the other end of the swing member is connected to the sheet amount indicator. As the sheet loading plate moves vertically according to the amount of loaded sheets, the swing member having one end of which in contact with the lower side of the loading surface of the sheet loading plate swings. In response to the movement, the sheet amount indicator connected to the other end of the swing member moves vertically. The vertical movement of the sheet amount indicator visually indicates the amount of sheets loaded on the sheet loading plate.

To reduce the cost of the sheet feeding device, the sheet amount indicator can be used in common to multiple sheet containers that have different maximum loadable amounts.

However, in the sheet feeding device (i.e., the sheet loading device) disclosed in JP H10-297793-A, the position of the edge of the sheet amount indicator varies between a sheet full state and a sheet empty state according to the maximum loadable amount of the sheet container. Therefore, the maximum movable amount (the maximum amplitude) of the edge of the sheet amount indicator that extends from the slit having a given length of the cover member changes depending on the maximum loadable amount of the sheet container. Accordingly, the sheet feeding device disclosed in JP H10-297793-A cannot determine the remaining amount of sheets loaded in the sheet container with accuracy depending on the position of the edge of the sheet amount indicator.

SUMMARY

At least one embodiment of the present invention provides a sheet feeding device including a sheet container that contains a sheet stack therein, an outer end part that is connected to the sheet container, a sheet feeding member to feed the sheet in the sheet container to an outside of the sheet feeding device, a swing shaft disposed at an upstream side of the sheet container in a sheet feeding direction, a sheet loading member having a loading surface on which the sheet in the sheet container is loaded, and being supported by the swing shaft to swing according to an amount of sheets loaded on the loading surface, a rotary shaft, and a sheet amount indicator being rotatably supported by the rotary shaft, having a contact end that contacts the sheet loading member swinging according to the amount of sheets loaded on the sheet loading member, and having a sheet amount display end disposed at an opposite side of the contact end with the rotary shaft in between and moving in a given display range visible from the outside of the sheet feeding device. The sheet loading member has a sloped surface sloped with respect to the loading surface and disposed at a portion where the contact end of the sheet amount indicator contacts the loading surface.

Further, at least one embodiment of the present invention provides an image forming apparatus including an image carrier to form an image on a surface thereof, and the above-described sheet feeding device to feed a sheet onto which the image is transferred.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
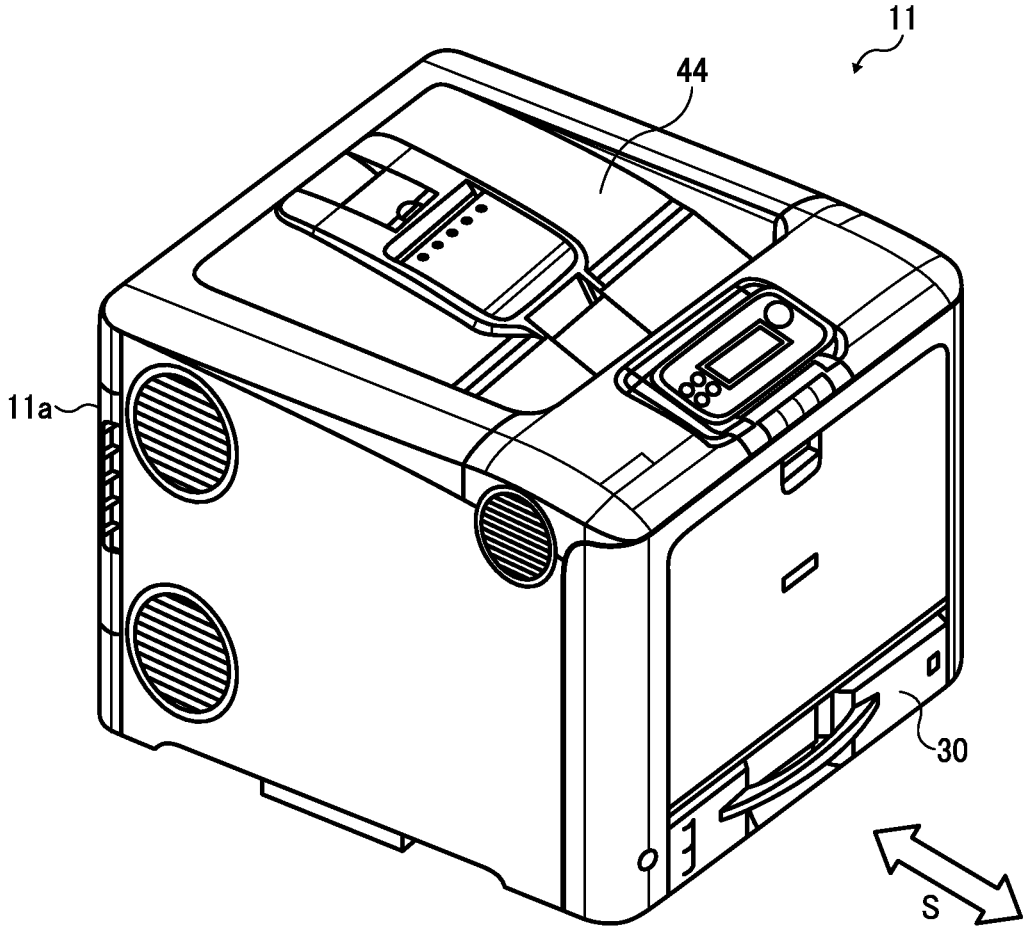
FIG. 1 is a perspective view illustrating an external configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an image forming apparatus 11 according to an embodiment of the present invention.

The image forming apparatus 11 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 11 is an electrophotographic laser printer that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

FIG. 1 illustrates an external perspective view illustrating a configuration of the image forming apparatus 11 according to the present embodiment.

The image forming apparatus 11 of FIG. 1 has an apparatus body 11*a* that includes a process cartridge at a substantially center part thereof. An exposure device is disposed below the process cartridge to expose a surface of a photoconductor drum that functions as an image carrier, so that an electrostatic latent image is formed on the surface of the photoconductor drum. A sheet tray 1 is disposed below the exposure device to load sheets as recording media. The image forming apparatus 11 further includes a transfer roller, a fixing device, and a sheet discharging roller pair in the apparatus body 11*a*. The transfer roller that functions as a transfer member is disposed facing the photoconductor drum to transfer a toner image formed on the surface of the photoconductor drum onto a sheet serving as a recording medium. The fixing device fixes the toner image transferred onto the sheet. The sheet discharging roller pair functions as a sheet discharging member to discharge the sheet having the toner image fixed thereto to a sheet discharging tray 44 disposed outside the apparatus body 11*a*.

Figure 3:
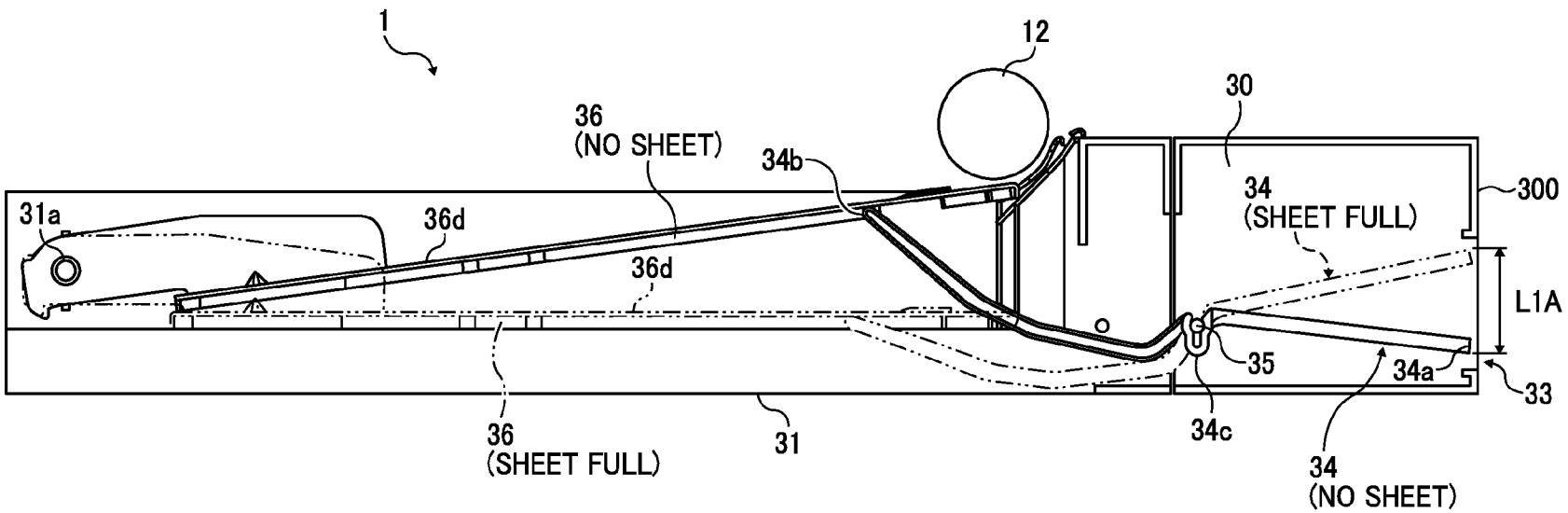
FIG. 3 is a cross sectional side view illustrating the sheet tray.

In the image forming apparatus 11, when a printing job is instructed, the sheet loaded on the sheet tray 1 is fed to a sheet conveying path by a sheet feed roller 12 that functions as a sheet feeding member (refer to FIG. 3). The sheet is then conveyed via a sheet conveying roller pair and a registration roller pair in a vertical direction of the drawing sheet. In synchronization with a time the leading edge of the sheet reaches the photoconductor drum, the leading edge of the toner image formed on the surface of the photoconductor drum reaches the transfer roller, so that the toner image is transferred onto the sheet. To prevent the toner image from removing from the sheet, the sheet is conveyed to the fixing device so that the toner image is fixed to the sheet by application of heat and pressure. The sheet with the fixed toner image thereon is discharged by the sheet discharging roller pair to the sheet discharging tray 44.

The sheet tray 1 is removably installed in the image forming apparatus 11 in an attaching/detaching direction indicated by arrow S.

Figure 2A:
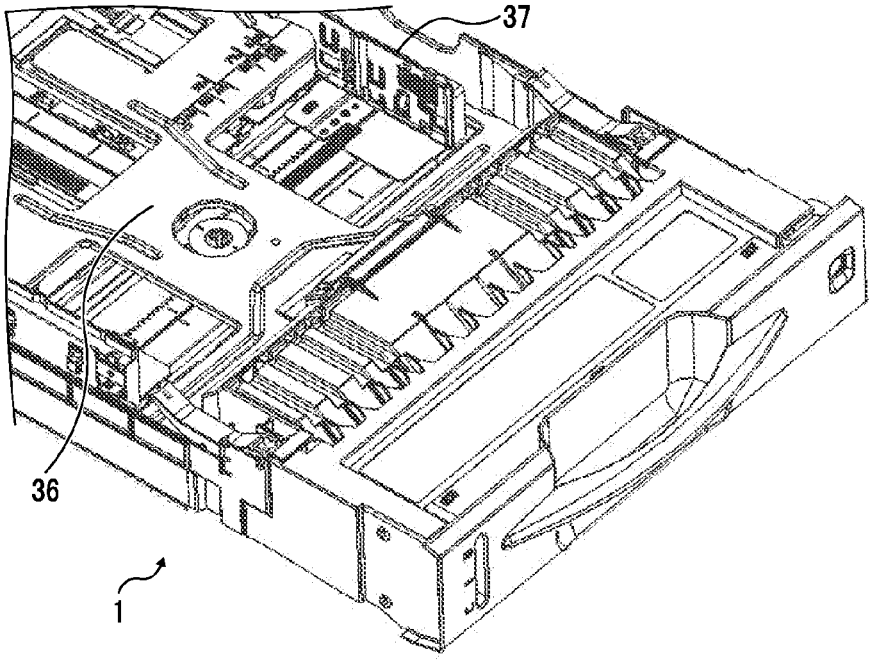
FIG. 2A is a perspective view illustrating a sheet tray in a state in which an outer end part and a sheet container are connected with each other.
Figure 2B:
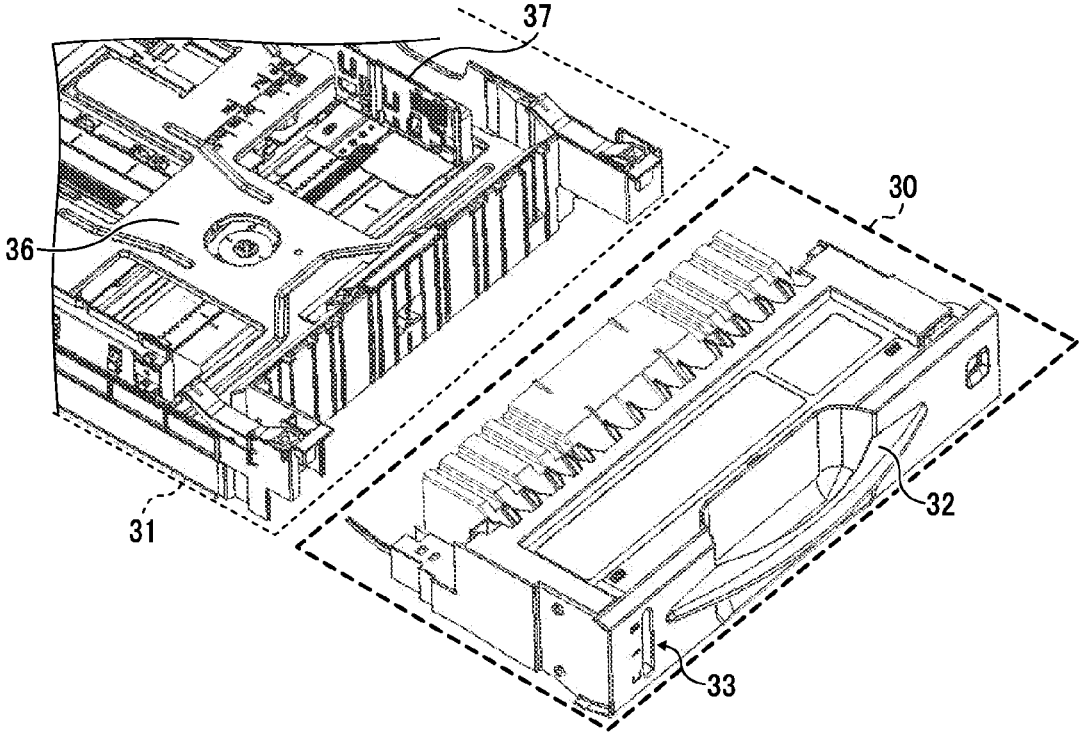
FIG. 2B is a perspective view illustrating the sheet tray in a state in which the outer end part and the sheet container are separated from each other.

FIGS. 2A and 2B are perspective views of the sheet tray 1. FIG. 2A illustrates the sheet tray 1 in a state in which an outer end part 30A and a sheet container 31 are connected with each other and FIG. 2B illustrates the sheet tray 1 in a state in which the outer end part 30B and the sheet container 31 are separated from each other. FIG. 3 is a cross sectional side view illustrating the sheet tray 1. The outer end part 30 includes an outer end surface 300.

As illustrated in FIGS. 2A and 2B, the sheet tray 1 includes the sheet container 31 and the outer end part 30A as separate parts. The outer end part 30 includes a handle 32 and a window 33. The handle 32 is attached to an outer surface of the outer end part 30 so that a user can pull out the sheet tray 1 from the apparatus body 11*a* of the image forming apparatus 11. The window 33 is arranged on the outer surface of the outer end part 30. The window 33 functions as a slit-type display aperture for visually acknowledging a sheet amount indicator 34 (refer to FIG. 3), which detects and displays the remaining amount of sheet. The sheet container 31 includes a sheet loading plate 36 and a side fence 37. The sheet loading plate 36 is rotatably supported by a swing shaft 31*a* that is provided at a downstream side of the sheet container 31 in a sheet feeding direction. The side fence 37 aligns a width or a lateral direction of a sheet stack loaded on the sheet loading plate 36.

The sheet container 31 that contains the sheets therein can be used in common to various types of image forming apparatuses. Specifically, the sheet tray 1 includes the outer end part 30 that can be replaced with a different outer end part 30 and the sheet container 31 that can be used in common. By so doing, the sheet tray 1 can be used as a sheet tray in various types of image forming apparatuses.

As illustrated in FIG. 3, the sheet container 31 includes the sheet loading plate 36 that functions as a sheet loading member to load a sheet or sheets thereon. The sheet loading plate 36 is rotatably supported by the swing shaft 31*a* of the sheet container 31. The swing shaft 31*a* that functions as a swing shaft of the sheet container 31 is disposed at the downstream side of the sheet container 31 in the sheet feeding direction. The downstream side of the sheet loading plate 36 corresponds to the rear end of the sheet container 31. The front end of the sheet loading plate 36 is biased by a biasing member such as a coil spring with respect to the sheet feed roller 12 that feeds the sheet.

The sheet tray 1 includes the sheet amount indicator 34 to detect the remaining amount of sheets loaded on the sheet loading plate 36 and display the remaining amount of sheet. The sheet amount indicator 34 is a long and narrow arm-shaped member.

The sheet amount indicator 34 includes a display part body 34*m* having a sheet amount display end 34*a*, a detector part body 34*k* having a sheet amount detector end 34*b*, and a rotary supported part 34*c*.

The rotary supported part 34*c* functions as a supporting target and is rotatably supported to a support shaft 35 that functions as a rotary shaft attached to the outer end part 30.

The display part body 34*m* having the sheet amount display end 34*a* is disposed at the right side of the outer end part 30 in FIG. 3. The sheet amount display end 34*a* of the display part body 34*m* functions as a display end to indicate the remaining amount of sheets through the window 33 of the outer end part 30.

The detector part body 34*k* having the sheet amount detector end 34*b* is disposed at the left side of the outer end part 30 in FIG. 3. The sheet amount detector end 34*b* functions as a contact end to detect the remaining amount of sheets loaded on the sheet loading plate 36 to contact a lower side of a loading surface 36*d* of the sheet loading plate 36 that moves in a vertical direction about the swing shaft 31*a*. The detector part body 34*k* having the sheet amount detector end 34*b* rotates with the sheet loading plate 36, so as to detect the amount of movement of the sheet loading plate 36.

As illustrated in FIG. 3, when the sheet loading plate 36 has no sheet loaded thereon (the sheet empty state), the sheet loading plate 36 and the sheet amount indicator 34 are located at respective positions drawn by solid lines. By contrast, when the sheet loading plate 36 has full of sheets thereon (the sheet full state), the sheet loading plate 36 and the sheet amount indicator 34 are located at respective positions drawn by dotted lines.

Consequently, the sheet amount display end 34*a* of the display part body 34*m* of the sheet amount indicator 34 lowers when the remaining amount of sheets loaded on the sheet loading plate 36 is small and elevates when the remaining amount of sheets loaded on the sheet loading plate 36 is large. The sheet amount display end 34*a* can indicate the remaining amount of sheets within a range of a movable amount L1A both when the sheet loading plate 36 has no sheet loaded thereon and when the sheet loading plate 36 has full of sheets loaded thereon. By so doing, a user can check the position of the sheet amount display end 34*a* of the display part body 34*m* of the sheet amount indicator 34 through the window 33 to visually acknowledge the remaining amount of sheets in the sheet tray 1 without pulling out the sheet tray 1.

It is preferable that components and units of the sheet tray 1 are used in common to reduce tooling cost, engineering processes, assessment processes, and so on. Except for the outer end part 30, the sheet container 31 and the sheet amount indicator 34 are demanded for common use in various types of sheet trays (e.g., the sheet tray 1).

Embodiment 1

A description is given of configurations of sheet trays 1A and 1B. The sheet tray 1A includes the sheet container 31 and an outer end part 30A connected to the sheet container 31. The sheet tray 1B includes the sheet container 31 and an outer end part 30B connected to the sheet container 31. Specifically, different types of outer end parts 30 (i.e., the outer end parts 30A and 30B) are used to the sheet trays 1A and 1B while the sheet container 31 is used in common to the sheet trays 1A and 1B. The outer end parts 30A and 30B include outer end surfaces 300A and 300B, respectively.

Figure 4A:
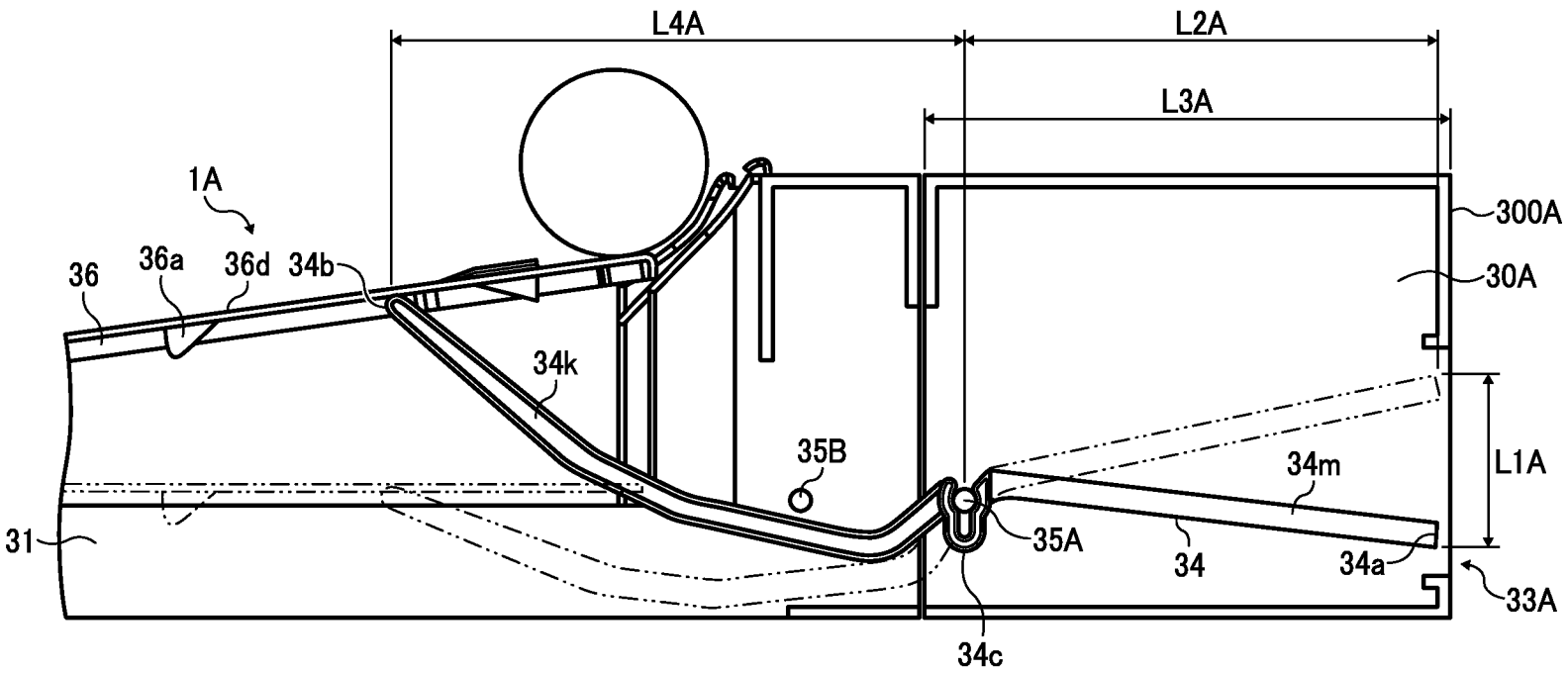
FIG. 4A is a cross sectional view illustrating a sheet tray having including a sheet container in connection with an outer end part having a long length in an attaching/detaching direction.
Figure 4B:
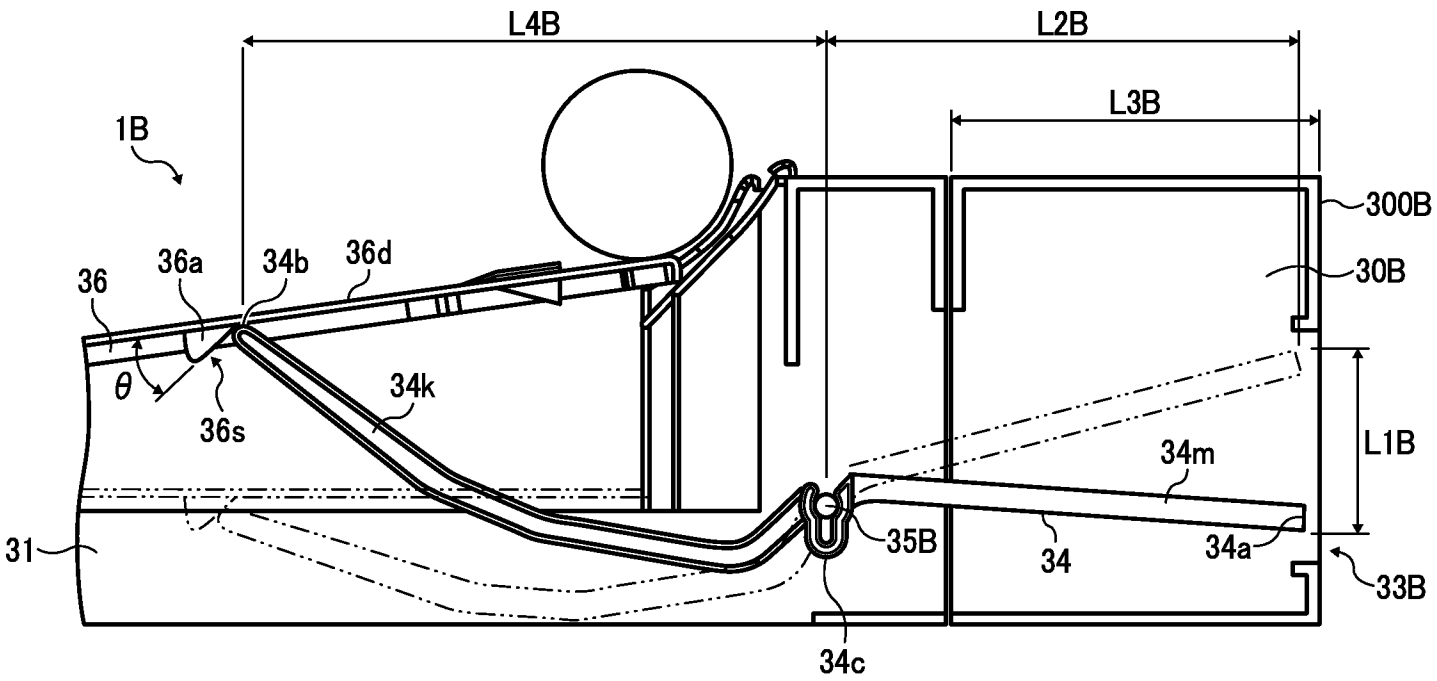
FIG. 4B is a cross sectional view illustrating a sheet tray having including a sheet container in connection with an outer end part having a short length in the attaching/detaching direction.

FIG. 4A is a cross sectional view illustrating the sheet tray 1A having a configuration in which the sheet container 31 and the outer and the outer end part 30A are connected to each other, and FIG. 4B is a cross sectional view illustrating the sheet tray 1B having a configuration in which the sheet container 31 and the outer end part 30B are connected to each other. In the configurations illustrated in FIGS. 4A and 4B, a length L3A of the outer end part 30A in the attaching/detaching direction S of the sheet tray 1A is greater than a length L3B of the outer end part 30B in the attaching/detaching direction S of the sheet tray 1B.

Figure 5:
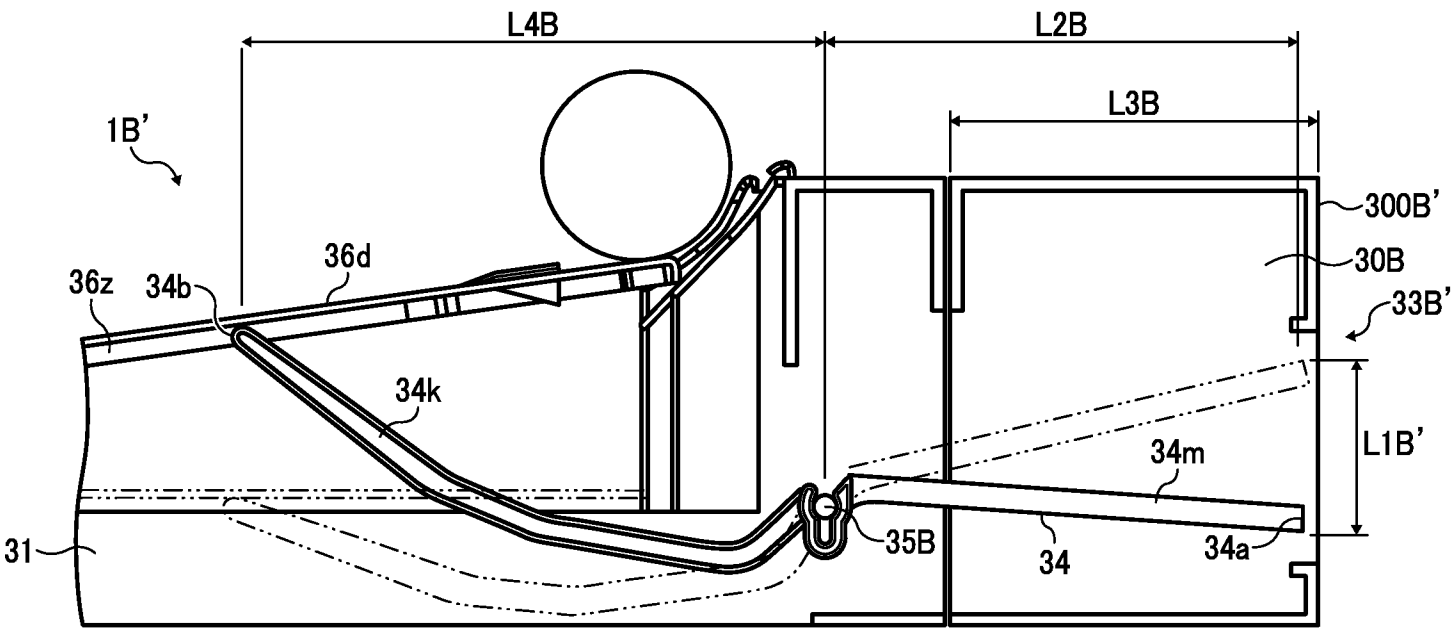
FIG. 5 is a cross sectional view illustrating a sheet tray as a comparative example.

FIG. 5 is a cross sectional view illustrating a sheet tray 1B' having a comparative sheet loading plate 36Z with a movable amount L1B'.

Similar to FIG. 3, the sheet loading plate 36 has no sheet loaded thereon when the sheet loading plate 36 and the sheet amount indicator 34 are located at respective positions drawn by solid lines, as illustrated in FIG. 4A. By contrast, the sheet loading plate 36 has full of sheets thereon when the sheet loading plate 36 and the sheet amount indicator 34 are located at respective positions drawn by dotted lines, as illustrated in FIG. 4B.

FIG. 4A illustrates a configuration of the sheet tray 1A in which the outer end part 30A having the length L3A is connected to the sheet container 31. The sheet amount indicator 34 has the rotary supported part 34*c* that is rotatably supported to a support shaft 35A attached to the outer end part 30A. At this time, the rotary supported part 34*c* and the sheet amount display end 34*a* have a distance L2A therebetween.

The sheet loading plate 36 rotates about the swing shaft 31*a* between the sheet full state in which the amount of sheets thereon is full and the sheet empty state in which the amount of sheets thereon is empty. Along with rotation of the sheet loading plate 36, the detector part body 34*k* having the sheet amount detector end 34*b* is rotated to cause the sheet amount display end 34*a* of the display part body 34*m* to move within the range of the movable amount L1A to indicate the remaining amount of sheets.

FIG. 4B illustrates a configuration of the sheet tray 1B in which the outer end part 30B having the length L3B is connected to the sheet container 31. To use the remaining amount display detection member 34 as a commonly used part, a distance L2B between the rotary supported part 34*c* and the sheet amount display end 34*a* illustrated in FIG. 4B is set to be equal to the distance L2A between the rotary supported part 34*c* and the sheet amount display end 34*a* illustrated in FIG. 4A. Therefore, in the present embodiment, the support shaft 35B is provided not to the outer end part 30B but to the sheet container 31 that is located at the back side (the left side in FIG. 4B) of the sheet tray 1B. According to this configuration, the sheet amount indicator 34 is rotatably supported by a support shaft 35B to which the rotary supported part 34*c* is attached. Thus, by providing the support shaft 35B that is used in the sheet tray 1B and the support shaft 35A that is used in the sheet tray 1A separately, the sheet amount indicator 34 can be used as a commonly used part. To use the sheet amount indicator 34 in common to the sheet trays 1A and 1B, a distance L4A between the rotary supported part 34*c* and the sheet amount detector end 34*b* of the sheet tray 1A is set to be equal to a distance L4B between the rotary supported part 34*c* and the sheet amount detector end 34*b*. By setting the distance L4A and the distance L4B equal to each other, the distance L2A between the rotary supported part 34*c* and the sheet amount display end 34*a* is set equal to the distance L2B between the rotary supported part 34*c* and the sheet amount display end 34*a*.

The sheet tray 1A illustrated in FIG. 4A does not have the support shaft 35B provided to the sheet container 31. However, the sheet tray 1A may have the support shaft 35B as long as the support shaft 35B does not interfere with movement of the sheet amount indicator 34. Specifically, by disposing the support shaft 35B at a position not to interfere with the sheet amount indicator 34, the sheet container 31 having an identical configuration can be used in common.

Further, the sheet tray 1A has two support shafts 35A and 35B. Therefore, it is likely that the rotary supported part 34*c* of the sheet amount indicator 34 is attached to the support shaft 35B by mistake at assembly. To avoid this inconvenience, the outer end part 30A may have an interfering part to interfere with the sheet amount indicator 34 when the sheet amount indicator 34 is fitted to the support shaft 35B. Specifically, the support shaft 35A may be extended toward the inside of the sheet tray 1A so that the sheet amount indicator 34 interferes with the support shaft 35A when the sheet amount indicator 34 is to be fitted to the support shaft 35B. In this case, the support shaft 35A functions as an interfering part.

When the sheet amount indicator 34 is shifted to a position closer to the inner side of the sheet tray 1B illustrated in FIG. 4B than the sheet amount indicator 34 in FIG. 4A, the distance L4B between the sheet amount detector end 34*b* and the rotary supported part 34*c* in the sheet tray 1B is same as the distance L4A between the sheet amount detector end 34*b* and the rotary supported part 34*c* in the sheet tray 1A. Therefore, a position at which the sheet amount detector end 34*b* contacts the sheet loading plate 36 shifts to the inner side of the sheet tray 1B, that is, toward the swing shaft 31*a*. At the contact position, an amount of movement of the sheet loading plate 36 is smaller, and therefore a detected amount of movement of the sheet amount detector end 34*b* of the detector part body 34*k* becomes smaller. Consequently, as illustrated in FIG. 5, the amount of movement of the sheet amount indicator 34 that is rotatably supported to the support shaft 35B also becomes smaller. As a result, the maximum range of movable amount of the sheet amount indicator 34 may change according to the position of the sheet amount indicator 34. For example, the maximum range of the movable amount L1B' of the sheet amount detector end 34*b* of the sheet amount indicator 34 in the sheet tray 1B' of FIG. 5 is smaller than the maximum range of the movable amount L1A of the sheet amount detector end 34*b* of the sheet amount indicator 34 in the sheet tray 1A of FIG. 4A.

If the maximum range of the movable amount L1A of the sheet amount indicator 34 of the sheet tray 1A and the maximum range of the movable amount L1B' of the sheet amount indicator 34 in the sheet tray 1B' are different, the sizes of windows 33A and 33B' are different as illustrated in FIGS. 4A and 5. This causes lack of design uniformity and change visibility of respective sheet trays. When using different sheet trays 1A and 1B in a multistage manner in a single image forming apparatus, the movable amounts L1A and L1B' preferably have the same maximum ranges to obtain design uniformity of the sheet trays 1A and 1B'.

To address this inconvenience, a projection part 36*a* is provided on the lower side of the sheet loading plate 36 to which the sheet amount detector end 34*b* contacts, as illustrated in FIGS. 4A and 4B. In other words, the projection part 36*a* illustrated in FIGS. 4A and 4B projects from the sheet loading plate 36 in a lower side direction. The projection part 36*a* includes a sloped surface that is inclined by an inclination angle 8 with respect to the loading surface 36*d* of the sheet loading plate 36. With the configuration in which the sheet amount detector end 34*b* (which is illustrated on the left side of FIGS. 4A and 4B) of the sheet amount indicator 34 contacts the projection part 36*a*, the detected amount of the sheet amount detector end 34*b* increases. This increases the amount of movement of the sheet amount indicator 34, thereby increasing the maximum range of a movable amount L1B of the sheet amount display end 34*a* of the display part body 34*m*.

It is to be noted that an angle and direction of a sloped surface 36*s* are arranged such that the maximum range of the movable amount L1B of the sheet amount display end 34*a* of the display part body 34*m* of the sheet amount indicator 34 provided in the sheet tray 1B is equal to the maximum range of the movable amount L1A of the sheet amount display end 34*a* of the display part body 34*m* of the sheet amount indicator 34 provided in the sheet tray 1A.

Figure 6:
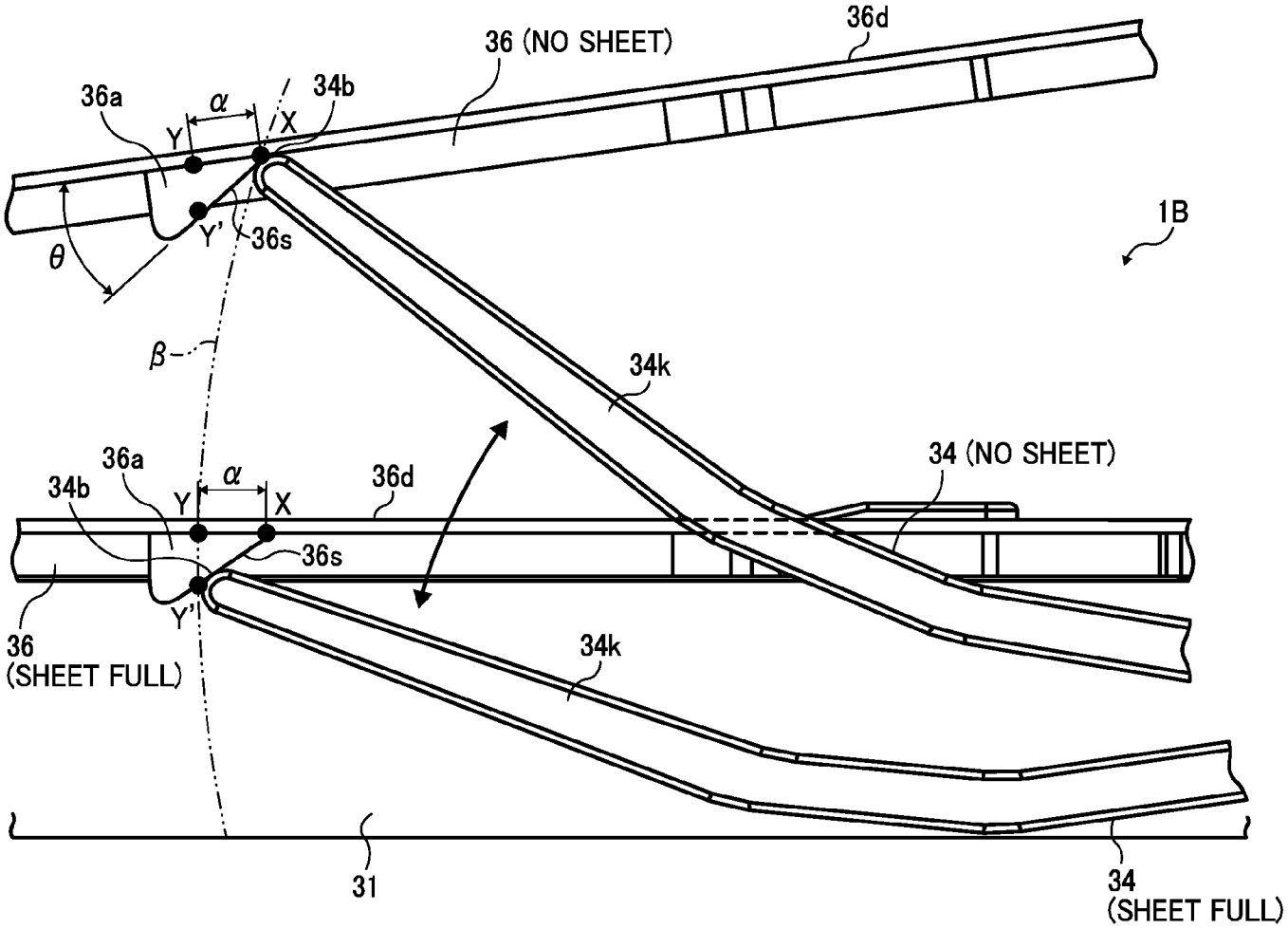
FIG. 6 is an enlarged view illustrating a configuration and functions of a sheet loading plate and a sheet amount indicator.

FIG. 6 is an enlarged view illustrating configurations and functions of the sheet loading plate 36 and the sheet amount indicator 34.

As illustrated in FIG. 6, a dotted line indicated by reference sign "β" indicates a rotational locus of the sheet amount detector end 34*b* of the sheet amount indicator 34, reference sign "X" indicates an intersection point of the sheet loading plate 36 with no sheet loaded thereon and the rotational locus β, and reference sign "Y" indicates an intersection point of the sheet loading plate 36 with full sheets loaded thereon and the rotational locus β. Along with movement of the sheet loading plate 36, a contact point (a leading point) of the sheet amount detector end 34*b* of the detector part body 34*k* of the sheet amount indicator 34 and the sheet loading plate 36 moves by a distance indicated by a reference sign "cc".

As a rotation center of the sheet amount indicator 34 substantially with respect to an extended line of an intermediate point of a rotation range of the sheet loading plate 36, the distance α increases. Therefore, the sheet loading plate 36 includes the projection part 36*a* having the sloped surface 36*s* inclined by the given inclination angle with respect to the loading surface 36*d* of the sheet loading plate 36, so that the sheet amount detector end 34*b* of the detector part body 34*k* of the sheet amount indicator 34 contacts the sloped surface 36*s*. By so doing, an intersection point of the sheet loading plate 36 with full sheets thereon and the rotational locus β shifts to an intersection point indicated by reference sign "Y'". With this configuration with the projection part 36*a* on the sheet loading plate 36, the maximum range of the movable amount L1B of the sheet amount display end 34*a* of the display part body 34*m* of the sheet amount indicator 34 is greater than that the maximum range of the movable amount L1B without the projection part 36*a*.

As described above, when the sheet amount indicator 34 is supported by and used in common by different support shafts such as the support shafts 35A and 35B, the maximum movable amounts L1A and L1B can be identical to each other. In the present embodiment, the sheet amount indicator 34 is used in common in the sheet trays 1A and 1B having different outer end parts such as the outer end parts 30A and 30B, respectively, and the maximum range of the movable amounts L1A and L1B identical to each other. For example, when the range of movement of the sheet loading plate 36 is different between the sheet trays 1A and 1B due to the different maximum sheet loadable amounts, the sloped surface 36*s* on the sheet loading plate 36 can adjust the maximum range of movement of the sheet amount indicator 34. By setting the angle and direction of the sloped surface 36*s* so that the maximum amount of the distance α is identical to the sheet trays 1A and 1B, the sheet amount indicator 34 can be used in common by the sheet trays 1A and 1B. Further, when the maximum sheet loadable amount of the sheet container 31 is different between the sheet loading plate 36 of the sheet tray 1A and the sheet loading plate 36 of the sheet tray 1B, the same sheet amount indicator 34 can be used in common.

It is to be noted that the sheet tray 1B illustrated in FIG. 6 has the projection part 36*a* having the sloped surface 36*s* projecting from the lower side of the sheet loading plate 36. In this configuration, since the projection part 36*a* having the sloped surface 36*c* projects downwardly from the sheet loading plate 36, an opening or the like is provided at a given position of the sheet container 31 so that the opening prevents interference of the sheet container 31 and the projection part 36*a* when the sheet loading plate 36 moves downward. In this case, however, rigidity of the sheet container 31 may be degraded.

Figure 7:
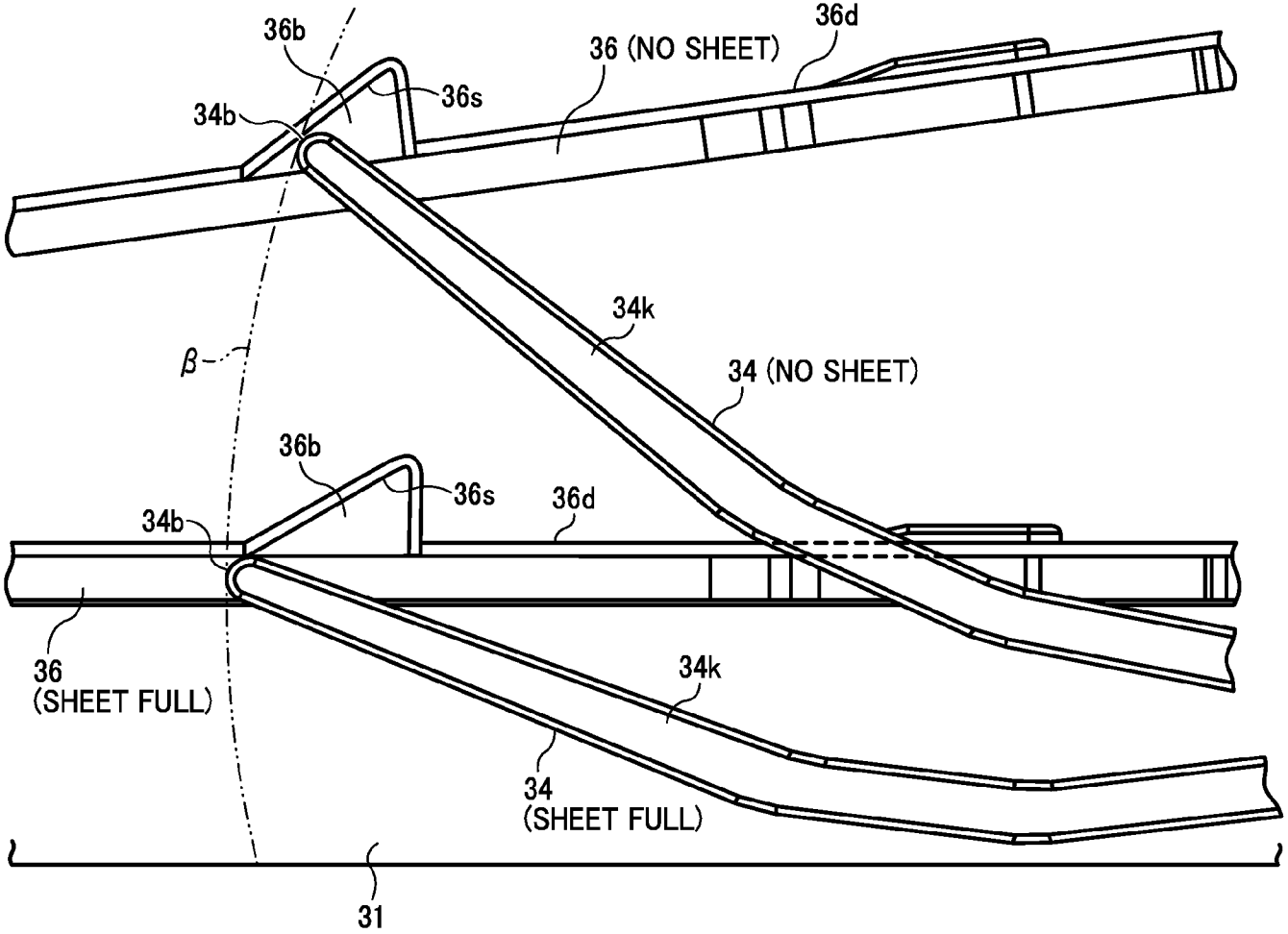
FIG. 7 is a cross sectional view illustrating the sheet container having a configuration in which a projection part is provided on an upper side of the sheet loading plate.

To address this inconvenience, the sheet tray 1 (e.g., the sheet tray 1A or the sheet tray 1B) illustrated in FIG. 7 may include a projection part 36*b* having the sloped surface 36*s* provided on an upper side of the sheet loading plate 36. In other words, the projection part 36*b* illustrated in FIG. 7 projects from the sheet loading plate 36 in an upper side direction. With this configuration, degradation of rigidity of the sheet container 31 can be prevented.

Figure 8:
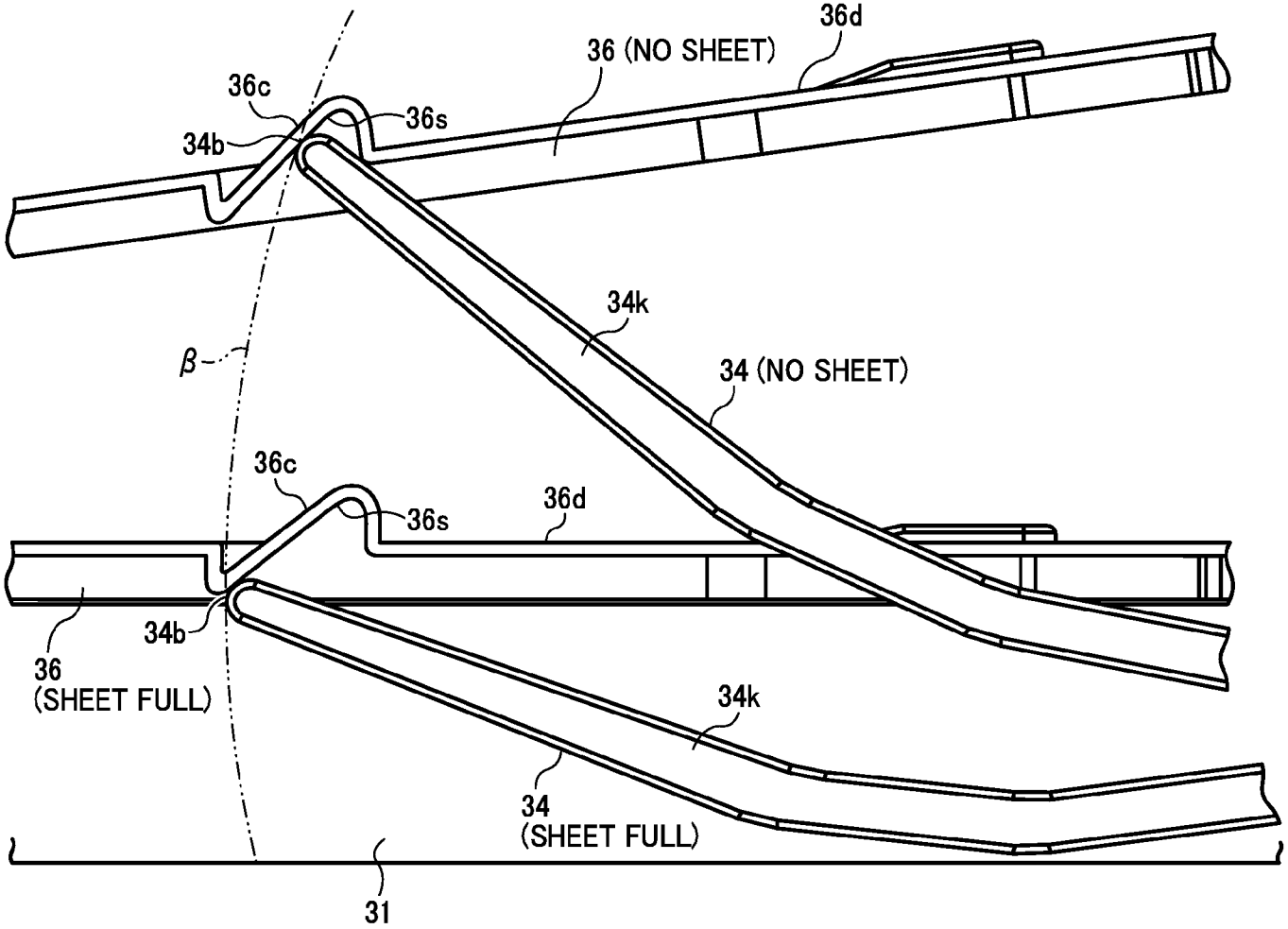
FIG. 8 is a cross sectional view illustrating the sheet container having a configuration in which a sloped surface connected with the projection part that extends on both upper and lower sides of the sheet loading plate.

Further, as illustrated in FIG. 8, the sheet tray 1 (e.g., the sheet tray 1A or the sheet tray 1B) may include a projection part 36*c* having the sloped surface 36*s* provided on both the upper side and the lower side of the sheet loading plate 36. In other words, the projection part 36*c* illustrated in FIG. 8 projects form the sheet loading plate 36 in an upper and lower side direction.

However, it is likely that contact the sheet loaded on the sheet loading plate 36 with the projection part 36*b* projecting from the upper side of the sheet loading plate 36 in the sheet tray 1 illustrated in FIG. 7 produces a load in sheet conveyance, which can degrade quality in a sheet conveying operation.

Figure 9:
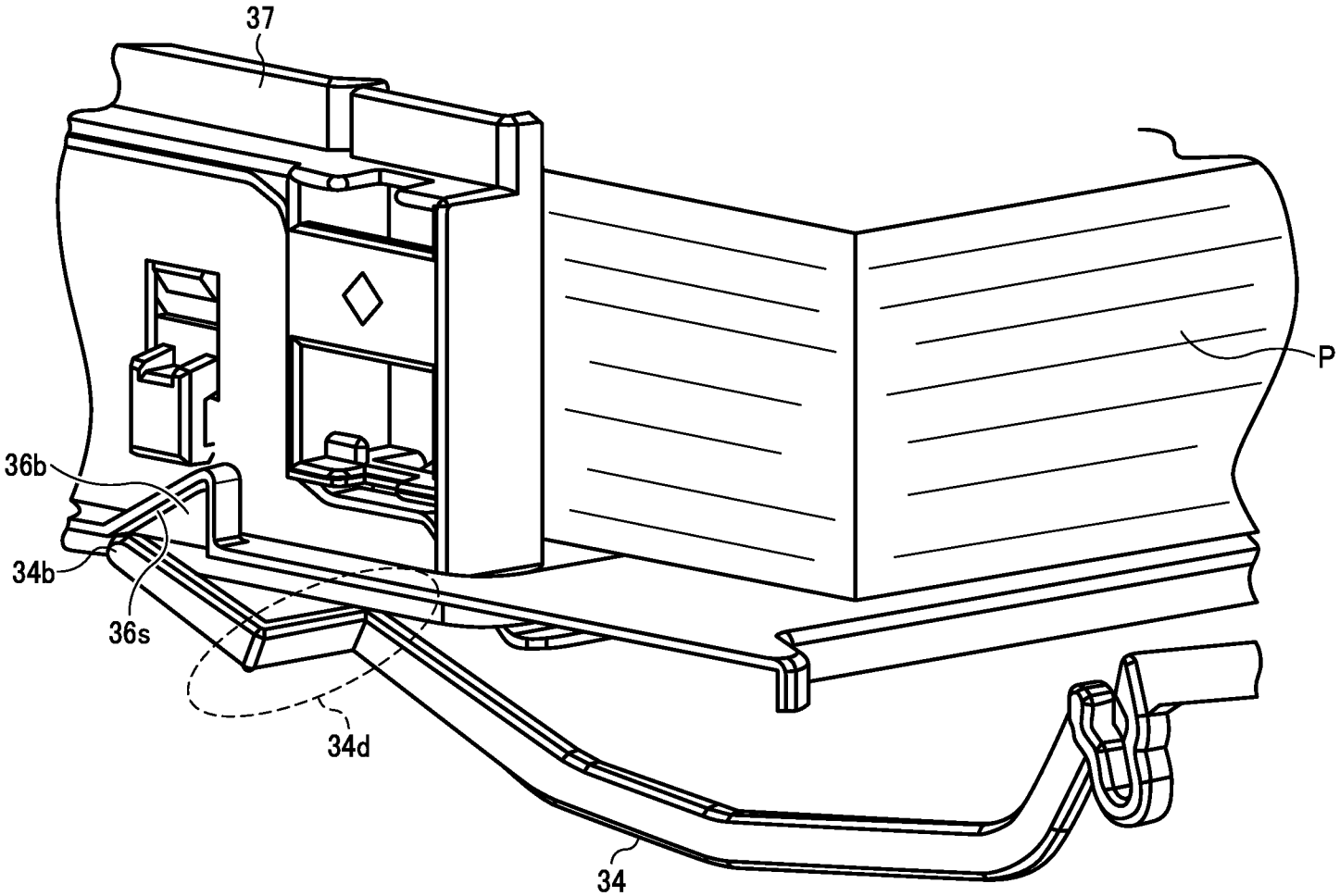
FIG. 9 is a perspective view illustrating the sheet container having a configuration in which the projection part is provided on an outer side of the sheet loading plate to be greater than a loadable sheet stack.

To avoid this inconvenience, the projection part 36*b* is preferably disposed outside the maximum sheet size of the loadable sheet stack P as illustrated in FIG. 9. By so doing, the contact of the projection part 36*b* with the sheet stack P can be avoided.

Further, by disposing the projection part 36*b* outside the maximum sheet size of the sheet stack P, the sheet amount indicator 34 is also provided outside the maximum sheet size of the sheet stack P. Consequently, depending on the configuration of the sheet feeding device, the size of the sheet tray 1 can increase.

To avoid this inconvenience, as illustrated in FIG. 9, the sheet amount indicator 34 that is a long and narrow arm-shaped member may further include a crank shaped bend 34*d* that is attached to the sheet amount indicator 34, so that an area around the sheet amount detector end 34*b* of the detector part body 34*k* of the sheet amount indicator 34 is disposed outside the maximum sheet size.

Further, as illustrated in FIG. 8, the sloped surface 36*s* may be connected to the projection part 36*c* that projects from both the upper side and the lower side of the sheet loading plate 36. In this case, since the projection part 36*c* projects from both the upper side and lower side of the sheet loading plate 36, an amount of projection on each side can be reduced. This configuration having projections on both the upper and lower sides of the sheet loading plate 36 can reduce the amount of projection of respective sides. Therefore, this configuration can easily avoid interference with the projection part 36*c*.

Further, as described above, each of the projection parts 36*a*, 36*b*, and 36*c* has the sloped surface 36*s* and can be formed integrally with the sheet loading plate 36. Consequently, this configuration can reduce the number of parts and components, and therefore can reduce the cost of the image forming apparatus 11.

However, when there are two or more types of the replaceable outer end parts 30 and the sloped surface 36*s* of each outer end part 30 is replaced, the projection parts 36*a*, 36*b*, and 36*c* having the respective sloped surfaces 36*s* are provided as separate parts to be replaced to assemble each customized outer end part 30.

Figure 10A:
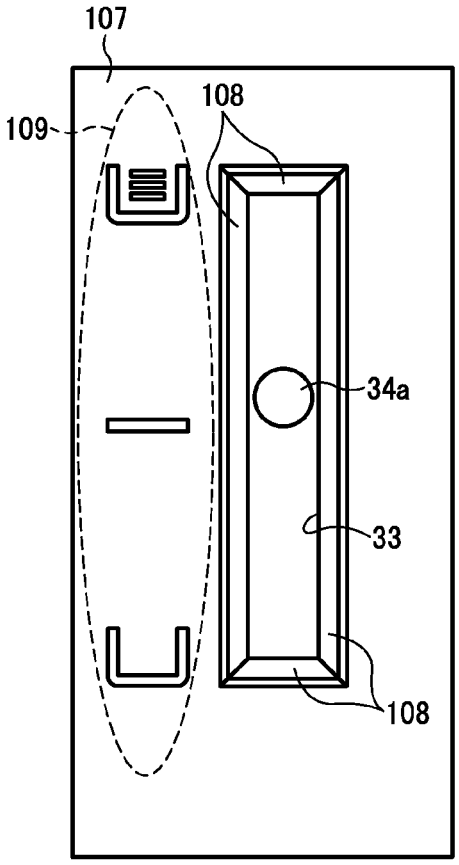
FIG. 10A is a front view illustrating a window of the sheet container.
Figure 10B:
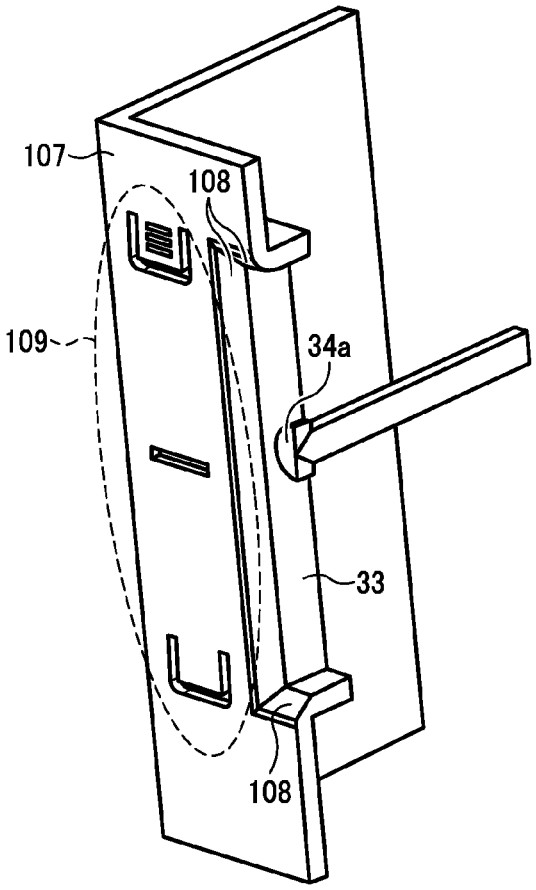
FIG. 10B is a perspective cross sectional view illustrating the window of the sheet container.

Next, a description is given of the window 33 through which a user acknowledges the sheet amount display end 34*a* of the display part body 34*m* of the sheet amount indicator 34 from outside, with reference to FIGS. 10A and 10B.

FIG. 10A is a front view of the window 33 of the sheet container 31 and FIG. 10B is a cross sectional view of the window 33. As illustrated in FIGS. 10A and 10B, the sheet amount display end 34*a* of the display part body 34*m* of the sheet amount indicator 34 can be observed from outside the image forming apparatus 11 through the window 33 mounted on the outer surface of the outer end part 30. According to the configuration having the window 33, any components other than the sheet amount display end 34*a* are not exposed to the outside of the sheet tray 1. Therefore, this configuration can prevent the sheet amount indicator 34 from being damaged.

Further, the window 33 has window sloped portions 108 arranged at four edges thereof. Each of the window sloped portions 108 includes a sloped surface that extends wider from an inner side toward an outer side at each end of the window 33. By so arranging the window sloped portions 108, visibility from the outside of the sheet tray 1 can be enhanced.

Further, the window 33 may have a graduation 109 on a peripheral part 107 of the window 33 to indicate the sheet remaining amount of sheets as recording media loaded on the sheet tray 1. The graduation 109 indicates the sheet full state at an upper part of the outer surface of the outer end part 30, a sheet half-full state at a middle part thereof, and the sheet empty state at a lower part thereof. By providing the graduation 109, the remaining amount of sheets can be grasped easily due to relative positions of the sheet amount display end 34*a* of the display part body 34*m* of the sheet amount indicator 34 and the graduation 109. By having a clear grasp of the remaining amount of sheets, acknowledgement of the sheet can be enhanced.

Further, the sheet amount display end 34*a* of the display part body 34*m* of the sheet amount indicator 34 is disposed separate from the outer surface of the outer end part 30 and closer to the inner side of the outer end part 30 than the outer surface of the outer end part 30. Due to this configuration, the sheet amount display end 34*a* does not contact the window 33 unintentionally, and therefore the sheet amount display end 34*a* of the display part body 34*m* of the sheet amount indicator 34 is prevented from being damaged.

Embodiment 2

A description is given of another configuration of the sheet tray 1 having various outer surfaces according to Embodiment 2, with reference to FIGS. 11A, 11B, 12, 13A, and 13B.

In Embodiment 1, when the length of the outer end part 30 in the attaching/detaching direction S of the sheet tray 1 is small, the support shaft 35 of the sheet container 31 supports the sheet amount indicator 34. However, when the length of the outer end part 30 in the attaching/detaching direction S of the sheet tray 1 is too small or too short, the sheet amount display end 34*a* of the display part body 34*m* of the sheet amount indicator 34 may project from the outer end surface 300 of the outer end part 30 to the outside of the sheet tray 1. This situation hinders the sheet amount indicator 34 to be used in common in the different sheet trays 1. Therefore, in the configuration of Embodiment 2, a length at the side of the sheet amount display end 34*a* of the sheet amount indicator 34 is changeable.

Figure 11A:
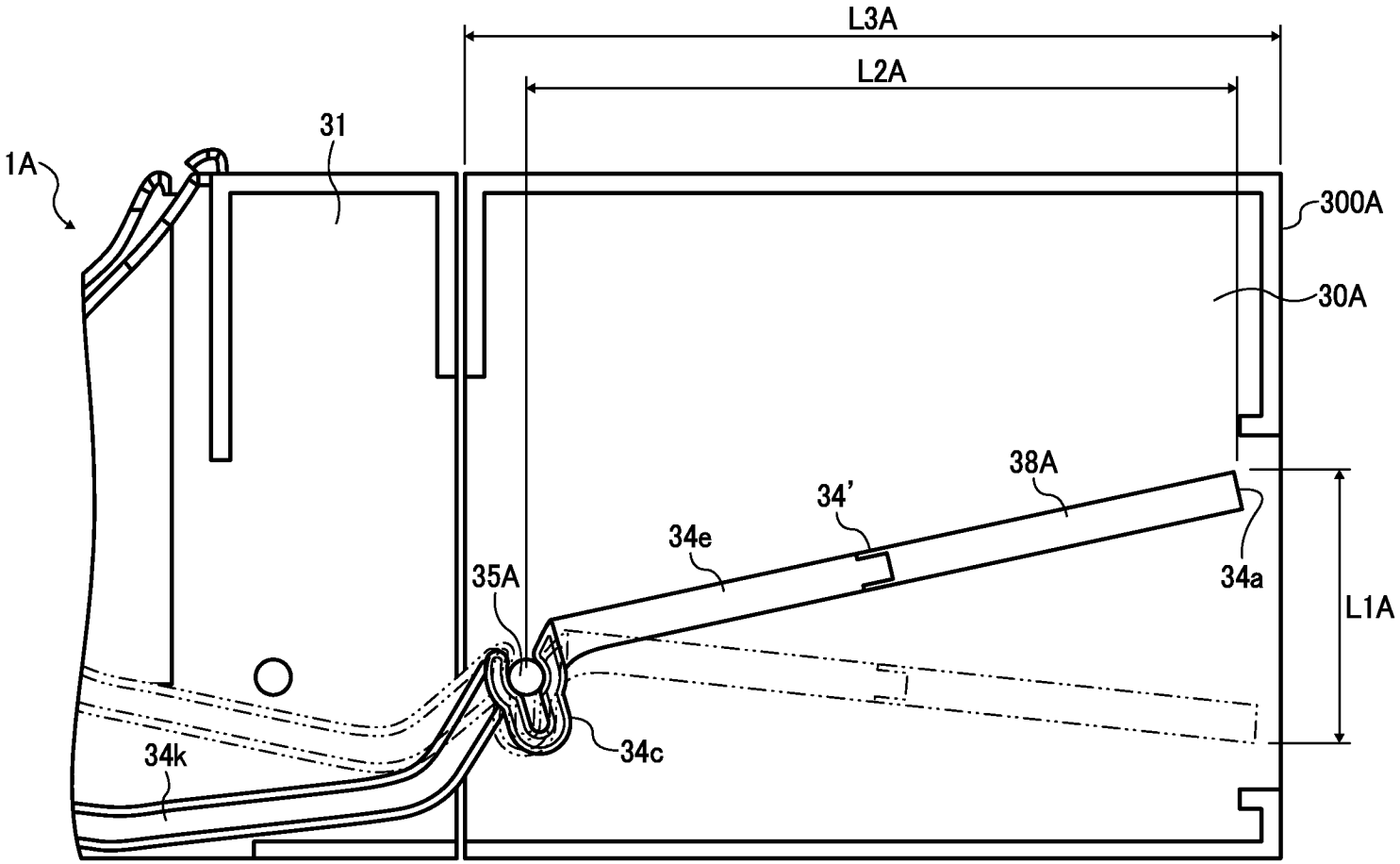
FIG. 11A is a diagram illustrating a base member and a long length adjuster connected to the base member.
Figure 11B:
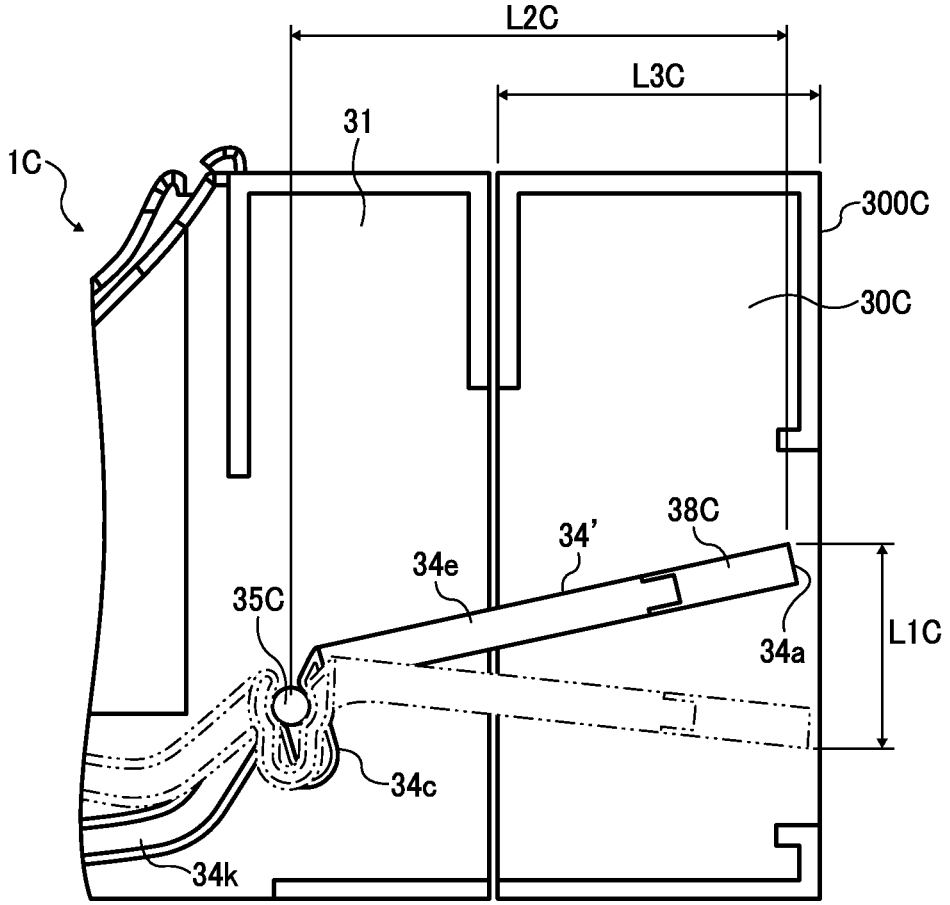
FIG. 11B is a diagram illustrating the base member and a short length adjuster connected to the base member.

FIGS. 11A and 11B are cross sectional views illustrating respective configurations of the sheet tray 1 having two separate parts for a sheet amount indicator 34'. FIG. 11A illustrates a configuration of the sheet tray 1A in which the sheet amount indicator 34' includes the detector part body 34*k* having the sheet amount detector end 34*b*, the rotary supported part 34*c*, a base part 34*e*, and a length adjuster 38A. In the sheet 1A of FIG. 11A, the display part body 34*m* including the sheet amount display end 34*a* is separated into the base part 34*e* and the length adjuster 38A. FIG. 11B illustrates a configuration of a sheet tray 1C in which the sheet amount indicator 34' includes the detector part body 34*k* having the sheet amount detector end 34*b*, the rotary supported part 34*c*, the base part 34*e*, and a length adjuster 38C. In the sheet 1C of FIG. 11B, the display part body 34*m* including the sheet amount display end 34*a* is separated into the base part 34*e* and the length adjuster 38C.

The sheet tray 1A illustrated in FIG. 11A includes the sheet container 31 and the outer end part 30A having the length L3A. The sheet container 31 and the outer end part 30A having the outer end surface 300A are connected to each other. Also, the sheet tray 1C illustrated in FIG. 11B includes the sheet container 31 and an outer end part 30C having a length L3C. The sheet container 31 and the outer end part 30C having an outer end surface 300C are connected to each other. As illustrated in FIGS. 11A and 11B, the length L3A between the rotary supported part 34*c* and the sheet amount display end 34*a* in the sheet tray 1A is set longer or greater than the length L3C between the rotary supported part 34*c* and the sheet amount display end 34*a* in the sheet tray 1C.

The sheet tray 1C illustrated in FIG. 11B has a distance L2C between the rotary supported part 34*c* and the sheet amount display end 34*a* is set smaller or shorter than the distance L2A between the rotary supported part 34*c* and the sheet amount display end 34*a*. If the sheet amount indicator 34' used in the sheet tray 1A illustrated in FIG. 11A is supported by the support shaft 35C disposed in the sheet tray 1C, the sheet amount display end 34*a* projects from the outer end surface 300C of the outer end part 30C to the outside of the sheet tray 1C. Therefore, the sheet amount indicator 34' used in the sheet tray 1C illustrated in FIG. 11B includes a length adjuster 38C that is smaller or shorter than the length adjuster 38A illustrated in FIG. 11A. The base member 34*e* is connected to the length adjuster 38C in the sheet tray 1C. To fit in the sheet tray 1C, the length L3C between the rotary supported part 34*c* and the sheet amount display end 34*a* in the sheet tray 1C is set smaller or shorter than the distance L2C between the end of the outer end surface 300C and the support shaft 35C. As a result, this configuration can prevent the sheet amount display end 34*a* from projecting outside from the outer end surface 300C of the outer end part 30C.

In Embodiment 2, the sheet amount indicator 34' includes two parts, which are the base member 34*e* and the length adjuster 38 (i.e., the length adjuster 38A or the length adjuster 38B). With this configuration, the base member 34*e* as a larger part of the sheet amount indicator 34' is used in common to the sheet trays 1A and 1C and the length adjuster 38 as a smaller part of the sheet amount indicator 34 is customized to fit in the respective sheet trays 1A and 1C.

Compared to the sheet amount indicator 34 as a single unit, the sheet amount indicator 34' includes two parts, which increases the number of parts. However, the base member 34*e* can be a common part and the length adjuster 38 can be separately manufactured to some different types of parts. Therefore, compared to a case in which different types of the integrated sheet amount indicator 34 are manufactured, the sheet amount indicator 34' having different parts connected with each other can contribute to a reduction in total cost of the image forming apparatus 11.

Figure 12:
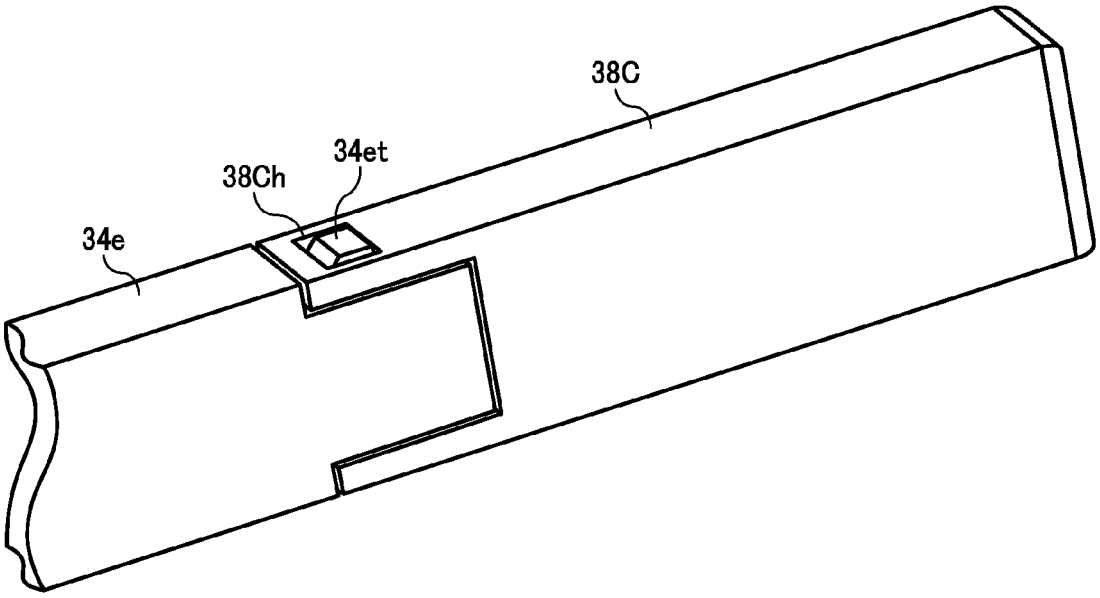
FIG. 12 is a perspective view illustrating a connection mechanism.

Further, the base member 34*e* and the length adjuster 38A or the length adjuster 38C of the sheet amount indicator 34 are connected to each other by using elastic deformation of the parts and components. Therefore, the base member 34*e* and the length adjuster 38 can be connected without additionally including a fixing member such as a screw. The base member 34*e* and the length adjuster 38A/the length adjuster 38C are resin members such as ABS (Acrylonitrile-Butadiene-Styrene) resin, PS (Polystyrene) resin or the like. Specifically, as illustrated in FIG. 12, the base member 34*e* includes a hook portion 34*et* and the length adjuster 38C includes a channel opening 38Ch that is connectable to the hook portion 34*et*. By inserting the hook portion 34*et* of the base member 34*e* into the channel opening 38Ch of the length adjuster 38 with the hook portion 34*et* being bent, the length adjuster 38C can be connected to the base member 34*e*.

Further, as illustrated in FIGS. 11A and 11B, when the distance L2A between the rotary supported part 34*c* and the sheet amount display end 34*a* of the sheet tray 1A is significantly different from the distance L2C between the rotary supported part 34*c* and the sheet amount display end 34*a* of the sheet tray 1C, the rotation angle of the sheet amount indicator 34' of sheet tray 1A and the maximum range of the movable amount L1A become different from the rotation angle of the sheet amount indicator 34' of sheet tray 1C and the maximum range of the movable amount L1C. Consequently, even when the projection part 36*a* having the sloped surface 36*c* is provided to the sheet loading plate 36 as the configuration described in Embodiment 1, it is likely to be difficult to set the maximum range of the movable amount L1A of the sheet amount display end 34' equal to the maximum range of the movable amount L1C of the sheet amount display end 34'.

Therefore, a separate part may be provided to the sheet amount detector end 34*b* of the detector part body 34*k* of the sheet amount indicator 34 so as to be replaced with a member having an angle toward the sheet loading plate 36.

Figure 13B:
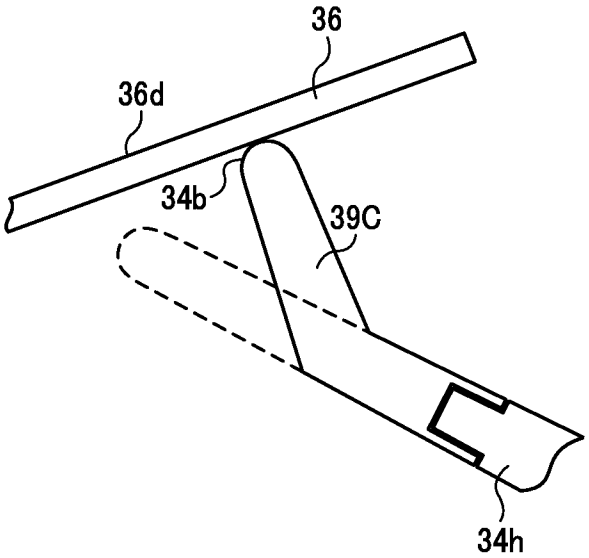
FIG. 13B is a diagram illustrating the sheet tray having a configuration in which an angle adjusting member with a different angle is connected as a separate part to the sheet amount detector body of the sheet amount indicator.
Figure 13A:
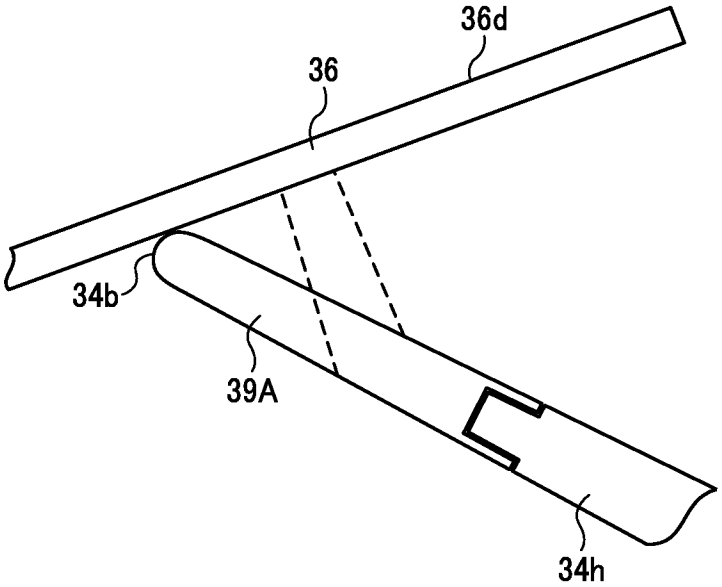
FIG. 13A is a diagram illustrating the sheet tray having a configuration in which an angle adjusting member with no angled surface is connected as a separate part to a sheet amount detector body of the sheet amount indicator.

FIGS. 13A and 13B are diagrams of the sheet amount indicator 34 having the detector part body 34*k* with the sheet amount detector end 34*b* as a separate part. FIG. 13A illustrates a configuration in which a straight member 39A having no angle is connected to a base member 34*h*. FIG. 13B illustrates a configuration in which an angle adjusting member 39C having a given angle is connected to the base member 34*h*.

In FIG. 13A, the straight member 39A is connected to the base member 34*h*. This configuration does not change the inclination angle of the detector part body 34*k* with the sheet amount detector end 34*b* and the distance between the sheet amount detector end 34*b* and the rotary supported part 34*c*. Consequently, the maximum range of the movable amount L1A of the sheet amount display end 34*a* of the display part body 34*m* does not change.

By contrast, in FIG. 13B, the angle adjusting member 39C is connected to the base member 34*h* so as to increase the maximum range of the movable amount L1C of the sheet amount display end 34*a*. By so doing, the sheet amount detector end 34*b* contacts the loading surface 36*d* of the sheet loading plate 36 substantially vertically, and therefore the swing angle (a rotation angle) of the sheet amount indicator 34 compared to the configuration in which the sheet amount detector end 34*b* contacts the loading surface 36*d* of the sheet loading plate 36 obliquely, as illustrated in FIG. 13A. Consequently, the maximum range of the movable amount L1C of the sheet amount display end 34*a* can be increased.

It is to be noted that the base member 34*h* has at least the rotary supported part 34*c*. Further, the base member 34*h* may have the rotary supported part 34*c* and the sheet amount display end 34*a* in an integral unit.

As described above, the sheet amount detector end 34*b* of the detector part body 34*k* of the sheet amount indicator 34 is provided as a separate member, so that either the straight member 39A or the angle adjusting member 39C is selected according to the type of the outer end part 30. This configuration can reduce the total manufacturing cost of the image forming apparatus 11 and the maximum ranges of the movable amounts L1A and L1C of the sheet amount display end 34*a* illustrated in FIG. 11A and the maximum ranges of the movable amounts L1A and L1C of the sheet amount display end 34*a* illustrated in FIG. 11B can be set equal to each other.

Further, similar to the above-described configuration, the base member 34*h*, the straight member 39A, and the angle adjusting member 39C are resin members and are connected to each other by using elastic deformation of the parts and components. By so doing, the base member 34*h*, the straight member 39A, and the angle adjusting member 39C are connected without adding a fixing member such as a screw and can be connected to each other with lower cost.

It is to be noted that the base member 34*h* may include the rotary supported part 34*c* and the length adjuster 38.

Embodiment 3

As described above, the sheet tray 1 according to Embodiment 2 has the configuration in which the sheet amount indicator 34 including multiple separate parts connected to each other is provided in the sheet trays 1A and 1C to which the outer end parts 30A and 30C having different lengths in the attaching/detaching direction S are selectively attached. According to this configuration, the projection of the sheet amount display end 34*a* of the display part body 34*m* from the outer surface of the outer end part 30 to the outside of the sheet tray 1 is prevented and the maximum ranges of the movable amounts L1A and L1C are to be identical to each other.

In Embodiment 3, the sheet tray 1 has a configuration in which the sheet amount indicator 34 is provided as a single unit by employing multiple sheet amount detector end s or multiple rotary supported parts to support the sheet amount indicator 34 at different positions.

Figure 14A:
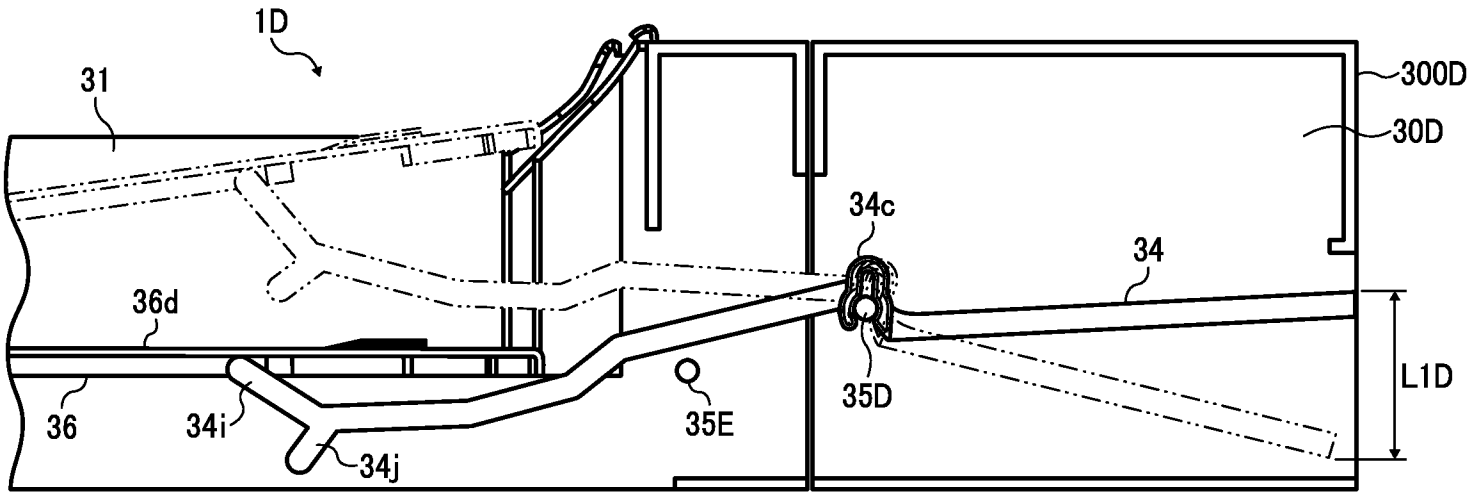
FIG. 14A is a cross sectional view illustrating the sheet tray having a configuration in which a long outer end part in the attaching/detaching direction is attached and the sheet amount indicator is rotatably supported to the long outer end part.
Figure 14B:
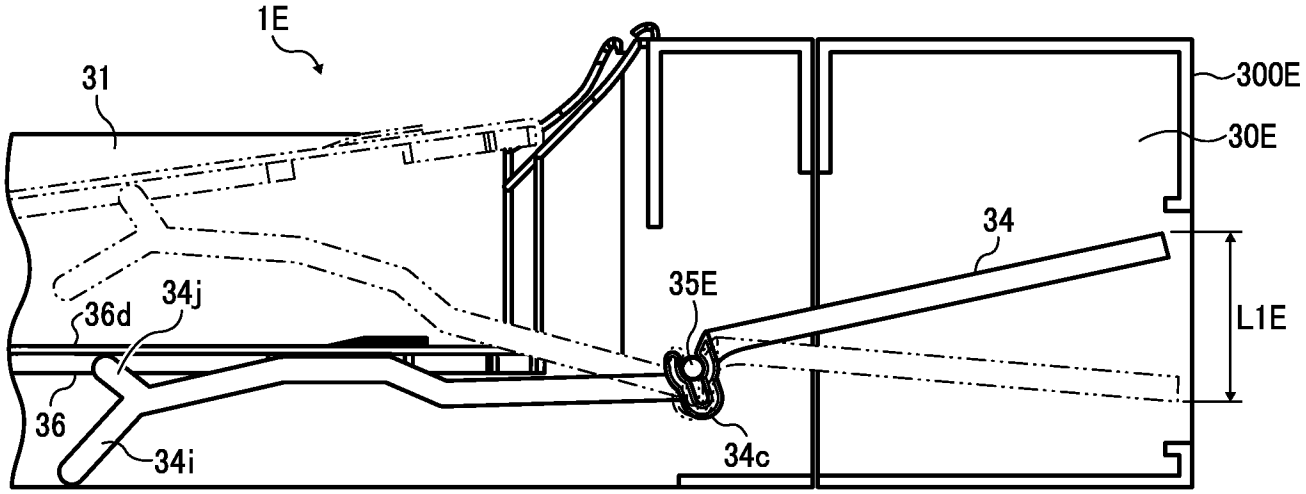
FIG. 14B is a cross sectional view illustrating the sheet tray having a configuration in which a short outer end part in the attaching/detaching direction is attached upside down to the sheet tray and the sheet amount indicator is rotatably supported to the short outer end part.

FIG. 14A is a cross sectional view illustrating a sheet tray 1D having a configuration in which an outer end part 30D extending in the attaching/detaching direction S is attached and the sheet amount indicator 34 is rotatably supported to the outer end part 30D. FIG. 14B is a cross sectional view illustrating a sheet tray 1E having a configuration in which an outer end part 30E extending in the attaching/detaching direction S is attached to the sheet tray 1E in an upside down manner compared to the outer end part 30D of the sheet tray 1D and the sheet amount indicator 34 is rotatably supported to the outer end part 30E, the length of which is shorter than the outer end part 30D. With the configurations of the sheet trays 1D and 1E, the sheet amount indicator 34 can be used in common to the sheet trays 1D and 1E.

As illustrated in FIG. 14A, the sheet tray 1D with the outer end part 30D in the attaching/detaching direction S of the sheet container 31 includes the rotary supported part 34*c* of the sheet amount indicator 34 that is attached to a support shaft 35D of the outer end part 30D with an open space in the vicinity of the leading edge of the sheet amount indicator 34 facing down. The sheet amount indicator 34 of the sheet tray 1D includes a plurality of projections having different lengths from each other to contact the sheet loading plate 36. The plurality of projections are a first projection 34*j* and a second projection 34*i* having a length longer or greater than the first projection 34*j*. In the sheet tray 1D, the second projection 34*i* contacts the sheet loading plate 36 with the open space having an acute angle of the second projection 34*i* and the first projection 34*j* facing down in a normal manner or a face-down manner.

As illustrated in FIG. 14B, the sheet tray 1E with the outer end part 30E in the attaching/detaching direction S of the sheet container 31 includes the rotary supported part 34*c* of the sheet amount indicator 34 that is attached to a support shaft 35E of the outer end part 30E with the open space in the vicinity of the leading edge of the sheet amount indicator 34 facing up. The sheet amount indicator 34 of the sheet tray 1E also includes the plurality of projections, which are the first projection 34*j* and the second projection 34*i*. In the sheet tray 1E, the first projection 34*j* contacts the sheet loading plate 36 with the open space facing down in an upside down manner or a face-up manner.

Thus, the contact part of the sheet amount indicator 34 with the sheet loading plate 36 is changed by reversing the attaching position of the sheet amount indicator 34 upside down. By so doing, the sheet trays 1D and 1E can provide the identical amount of rotation of the sheet amount indicator 34 and the same maximum ranges of the movable amounts L1D and L1E.

Figure 15A:
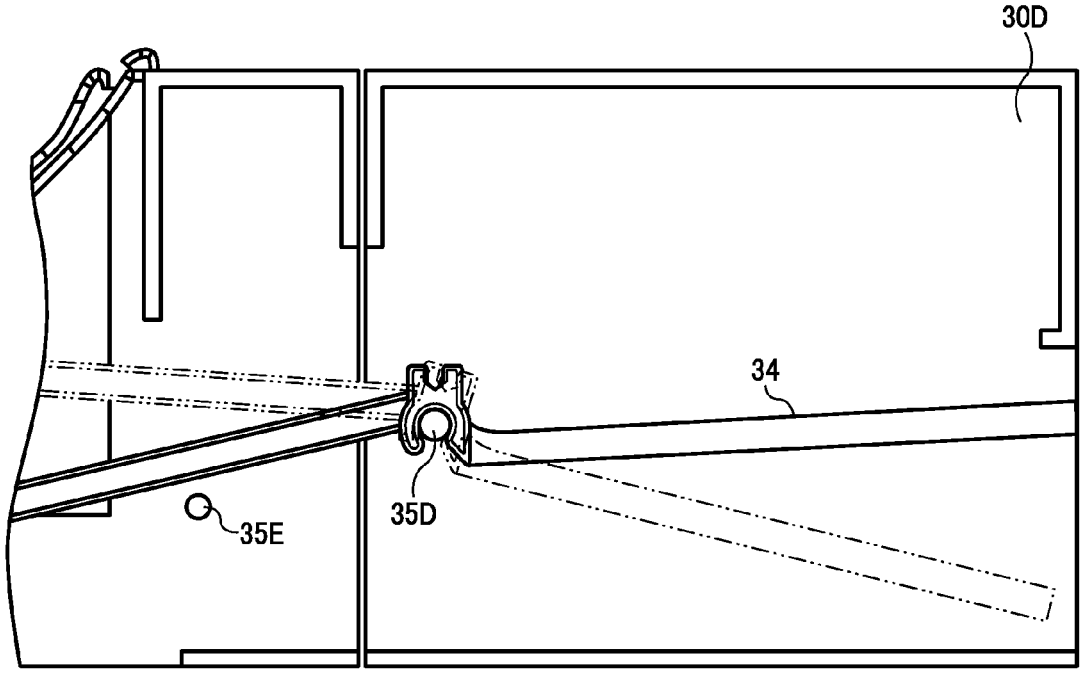
FIG. 15A is a cross sectional view illustrating the sheet tray having a configuration in which a sheet amount indicator having two rotary supported parts having different inner diameters.
Figure 15B:
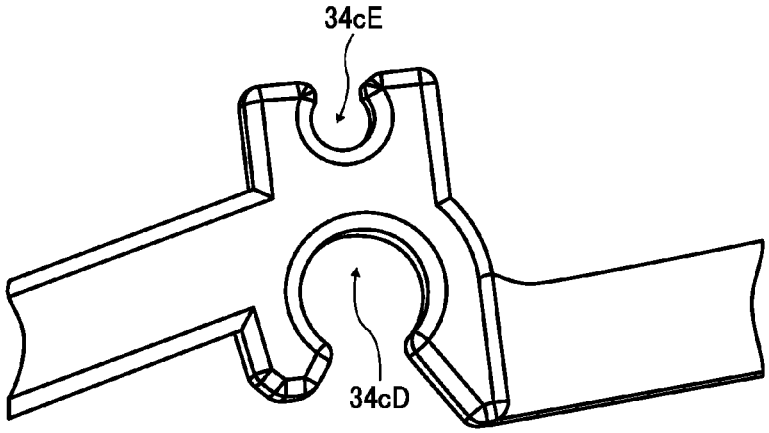
FIG. 15B is an enlarged view illustrating the rotary supported part.

Further, as illustrated in FIGS. 15A and 15B, two rotary supported parts 34*c*D and 34*c*E having different inner diameters may be provided to the sheet amount indicator 34. According to this configuration, the sheet trays 1D and 1E can selectively use the support shafts 35D and 35E. In this case, respective outer diameters of the support shafts 35D and 35E are different from each other, so that each of the support shafts 35D and 35E can be selectively attached to either one of the rotary supported parts 34*c*D and 34*c*E. This configuration can prevent a different support shaft 35 (i.e., the support shafts 35D and the 35E) from receiving the sheet amount indicator 34.

In the above-described embodiments of the present invention, the sheet tray as the sheet feeding device is applied to the image forming apparatus described as a laser printer. However, the configuration is not limited to the laser printer. For example, as described above, the image forming apparatus may be a copier, a facsimile machine, a printer, a plotter, a multifunction peripheral or a multifunction printer (MFP) having at least one of copying, printing, scanning, facsimile, and plotter functions, or the like.

Further, the sheet feeding device according to the above-described embodiments can be applied to an image reading device that reads images and characters on an original document that is fed from a document container in which a stack of sheet-like documents.

The configurations according to the above-described embodiment are examples. The present invention can achieve the following aspects effectively.

[Aspect A]

In Aspect A, a sheet feeding device (for example, the sheet tray 1) has a configuration including a sheet container (for example, the sheet container 31) to contain a sheet stack (for example, the sheet stack P) therein, an outer end part (for example, the outer end part 30) that is connected to the sheet container, a sheet feeding member (for example, the sheet feed roller 12) to feed a sheet of the sheet stack in the sheet container to an outside of the sheet feeding device, a swing shaft (for example, the swing shaft 31*a*) that is disposed at an upstream side of the sheet container in the sheet feeding direction, a sheet loading member (for example, the sheet loading plate 36) that has a loading surface (for example, the loading surface 36*d*) on which the sheet in the sheet container is loaded and that is supported by the swing shaft to swing according to an amount of sheets of the sheet stack loaded on the loading surface, a rotary shaft (for example, the support shaft 35), and a sheet amount indicator (for example, the sheet amount indicator 34) that is rotatably supported by the rotary shaft, and that has a contact end (for example, the sheet amount detector end 34*b*) contacting the sheet loading member swinging according to the amount of sheets loaded on the sheet loading member and a sheet amount display end (for example, the sheet amount display end 34*a*) being disposed at an opposite side of the contact end with the rotary shaft in between and moving in a given display range visible from the outside of the sheet feeding device. The sheet loading member has a sloped surface (for example, the sloped surface 36*s*) disposed at a portion where the contact end of the sheet amount indicator contacts the sheet loading member and sloped with respect to the loading surface of the sheet loading member.

Accordingly, as described in the above-described embodiments, while the contact end of the sheet amount indicator remains in contact with the sloped surface of the loading surface of the sheet loading member, when the sheet loading member swings, the contact end moves along the sloped surface. Consequently, compared with a configuration without the sloped surface, the amount of swing of the sheet amount indicator increases, and therefore the maximum range of a movable amount of the contact end between a sheet full state and a sheet empty state can be made greater. Further, by using the sheet amount indicator in common, a reduction in manufacturing cost can be achieved.

[Aspect B]

In Aspect A, an angle and direction of slope of the sloped surface (for example, the sloped surface 36*s*) with respect to the loading surface (for example, the loading surface 36*d*) is set so that the sheet amount display end (for example, the sheet amount display end 34*a*) of the sheet amount indicator (for example, the sheet amount indicator 34) moves a whole range of a given display amount between a sheet full state and a sheet empty state of the sheet on the sheet loading member (for example, the sheet loading plate 36).

Accordingly, even when the sheet amount indicator is used in common to various sheet containers having the different maximum loadable amounts, the amount of sheets on the sheet loading member in the sheet full state and the sheet empty state can be acknowledged accurately according to a position of the sheet amount display end of the sheet amount indicator.

[Aspect C]

In Aspects A or B, the outer end part (for example, the outer end part 30) includes an outer end surface (for example, the outer end surface 300) having a display aperture (for example, the window 33) in which the sheet amount display end (for example, the sheet amount display end 34*a*) is moved. The rotary shaft (for example, the support shaft 35) that rotatably supports the sheet amount indicator (for example, the sheet amount indicator 34) includes multiple rotary shafts (for example, the support shafts 35A and 35B) at different positions from each other from the outer end surface of the outer end part. The sheet amount indicator is detachably attached to a corresponding one of the multiple rotary shafts.

Accordingly, as described in the above-described embodiments, when the sheet amount indicator is used in common to the multiple sheet containers having different distances between the outer end surface of the outer end part and the sheet container (for example, the sheet container 31), the sheet amount indicator can be attached to an appropriate rotary shaft of the multiple rotary shafts. Further, the sheet amount display end of the sheet amount indicator can be positioned at the display aperture of the outer end part reliably. Therefore, even when the sheet amount indicator is used in common to the multiple sheet containers having different distances between the outer end surface of the outer end part and the sheet container, the remaining amount of sheets both at the sheet full state and the sheet empty state can be acknowledged with accuracy according to the position of the sheet amount display end of the sheet amount indicator.

[Aspect D]

In Aspects A through C, the outer end part (for example, the outer end part 30) has a display aperture (for example, the window 33) in which the sheet amount display end (for example, the sheet amount display end 34*a*) of the sheet amount indicator (for example, the sheet amount indicator 34) is moved, and is detachably attached to the sheet container (for example, the sheet container 31). The rotary shaft (for example, the support shaft 35) that rotatably supports the sheet amount indicator includes multiple rotary shafts (for example, the support shafts 35A and 35B) disposed both at the sheet container and the outer end part.

Accordingly, as described in the above-described embodiments, the sheet amount indicator can be attached to an appropriate rotary shaft of the multiple rotary shafts attached to the sheet container and the outer end part according to the size of the outer end part that is attached to the sheet container. Further, the sheet amount display end of the sheet amount indicator can be positioned at the display aperture of the outer end part reliably. Therefore, even when the sheet amount indicator is used in common to the multiple outer end parts of different sizes to be attached to the sheet container, the remaining amount of sheets both at the sheet full state and the sheet empty state can be acknowledged with accuracy according to the position of the sheet amount display end of the sheet amount indicator.

[Aspect E]

In Aspects A through D, the sloped surface (for example, the sloped surface 36*s*) is integrally included with the sheet loading member (for example, the sheet loading plate 36).

Accordingly, as described in the above-described embodiments, an increase in parts and components is prevented, and therefore a reduction in manufacturing cost can be achieved.

[Aspect F]

In Aspects A through E, the sloped surface (for example, the sloped surface 36*s*) projects from the sheet loading member (for example, the sheet loading plate 36) to one of an upper side direction that is the same side as the loading surface (for example, the loading surface 36*d*) lies on the sheet loading member, a lower side direction that is the opposite side of the loading surface, and an upper and lower side direction that is the same and opposite sides of the loading surface and corresponds to both sides of the sheet loading member.

Accordingly, as described in the above-described embodiments, when the sloped surface is provided to project in the upper side direction, which is the same side as the loading surface of the sheet loading member, the configuration can prevent an increase in the entire height of the sheet container (for example, the sheet container 31).

Further, when the sloped surface is provided to project in the lower side direction, which is the opposite side of the loading surface of the sheet loading member, the configuration can prevent contact of the sloped surface with the sheet loaded on the loading surface of the sheet loading member and/or interference of the sloped surface with the sheet feeding device (for example, the sheet tray 1).

Furthermore, when the sloped surface is provided to project in the upper and lower side direction, which is the both sides of the sheet loading member, the configuration can prevent the increase in the entire height of the sheet container, and contact of the sloped surface with the sheet loaded on the loading surface of the sheet loading member and/or interference of the sloped surface with the sheet feeding device.

[Aspect G]

According to Aspects A through F, the sloped surface (for example, the sloped surface 36*s*) is disposed at a position where the sloped surface does not interfere with the sheet on the sheet loading member (for example, the sheet loading plate 36).

Accordingly, as described in the above-described embodiments, this configuration can prevent the sloped surface from contacting the sheet and hindering the sheet conveying operation.

[Aspect H]

According to Aspects A through G, the sheet amount indicator (for example, the sheet amount indicator 34) is an arm-shaped member having a bend (for example, the crank shaped bend 34*d*).

Accordingly, as described in the above-described embodiments, the sheet amount indicator is bent at the crank shaped bend and can dispose the sloped surface (for example, the sloped surface 36*s*) outside the maximum sheet size that is loadable on the sheet loading member (for example, the sheet loading plate 36). Therefore, the degree of freedom of designing the sheet feeding device (for example, the sheet tray 1) is enhanced.

[Aspect I]

According to Aspects A through H, the outer end part (for example, the outer end part 30) has an interfering part (for example, the support shaft 35A) to interfere with attachment or movement of the sheet amount indicator (for example, the sheet amount indicator 34) when the sheet amount indicator is fitted to a rotary shaft (for example, the support shaft 35B) other than a target rotary shaft (for example, the support shaft 35A).

Accordingly, as described in the above-described embodiments, this configuration can prevent assembly failure in which the sheet amount indicator is fitted to a different rotary shaft.

[Aspect J]

In Aspects A through I, the sheet amount indicator (for example, the sheet amount indicator 34) includes a detecting part body (for example, the detector part body 34*k*) having the contact end (for example, the sheet amount detector end 34*b*) and a display part body (for example, the display part body 34*m*) having the sheet amount display end (for example, the sheet amount display end 34*a*) to be detachably attached to each other. The sheet feeding device (for example, the sheet tray 1) further includes a supported part (for example, the rotary supported part 34*c*) that is supported by the rotary shaft (for example, the support shaft 35) of the sheet amount indicator (for example, the sheet amount indicator 34) and is included in either one of the detecting part body and the display part body.

Accordingly, as described in the above-described embodiments, the sheet amount indicator includes the detecting part body and the display part body connected to each other. One of the detecting part body and the display part body is a part to be used in common and the other is a separate part. By so doing, the total cost of manufacturing the common parts and the separate parts can be reduced compared with the cost for manufacturing multiple single-unit sheet amount indicators.

[Aspect K]

In Aspect J, the detector part body and the display part body are elastically connected to each other.

Accordingly, as described in the above-described embodiments, the detector part body and the display part body are not connected to each other with a fixing member such as a screw, thereby enhancing a reduction in the total manufacturing cost.

[Aspect L]

In Aspects A through K, the supported part (for example, the rotary supported part 34*c*) that is supported by the rotary shaft (for example, the support shaft 35) of the sheet amount indicator (for example, the sheet amount indicator 34) includes multiple supported parts (for example, the rotary supported parts 34*c*D and 34*c*E) disposed at different positions of the sheet amount indicator.

Accordingly, as described in the above-described embodiments, when the sheet amount indicator is used in common to multiple sheet containers having different configurations from each other, an appropriate supported part is selected from the multiple supported parts provided to the sheet amount indicator to be supported by the rotary shaft. Therefore, even when the sheet amount indicator is used in common to the different type sheet containers, the remaining amount of sheets both at the sheet full state and the sheet empty state can be acknowledged with accuracy according to the position of the sheet amount display end (for example, the sheet amount display end 34*a*) of the sheet amount indicator.

[Aspect M]

In Aspect L, the multiple supported parts (for example, the rotary supported parts 34*c*D and 34*c*E) of the sheet amount indicator (for example, the sheet amount indicator 34) have different shapes from each other and the rotary shaft (for example, the support shaft 35) that rotatably supports the sheet amount indicator includes multiple rotary shafts (for example, the support shafts 35D and 35E) according to the respective shapes of the multiple supported parts.

Accordingly, as described in the above-described embodiments, the multiple supported parts of the sheet amount indicator is supported by the respective rotary shafts. Therefore, this configuration can prevent a mistake in assembling the sheet amount indicator to the rotary shaft.

[Aspect N]

In Aspects L and M, the sheet amount indicator (for example, the sheet amount indicator 34) has multiple contact ends (for example, the first projection 34*j* and the second projection 34*i*). When one of the multiple supported parts (for example, the rotary supported parts 34*c*D and 34*c*E) of the sheet amount indicator (for example, the sheet amount indicator 34) is supported by the rotary shaft (for example, the support shaft 35), one of the multiple contact ends contacts the sheet loading member (for example, the sheet loading plate 36).

Accordingly, as described in the above-described embodiments, when the sheet amount indicator is used in common to the multiple sheet containers having different configurations from each other, one of the contact ends of the sheet amount indicator supported by the rotary shaft contacts the sheet loading member reliably. Therefore, even when the rotary shaft is a simple single unit, the remaining amount of sheets both at the sheet full state and the sheet empty state can be acknowledged with accuracy according to the position of the sheet amount display end (for example, the sheet amount display end 34*a*) of the sheet amount indicator.

[Aspect O]

In Aspects A through N, the sheet amount indicator (for example, the sheet amount indicator 34) is supported by the rotary shaft (for example, the support shaft 35) in one of a normal manner (for example, the face-down manner as illustrated in FIG. 14A) and an upside down manner (for example, the face-up manner as illustrated in FIG. 14B) and the contact end (for example, the first projection 34*j* and the second projection 34*i*) contacts the sheet loading member (for example, the sheet loading plate 36).

Accordingly, as described in the above-described embodiments, by assembling the sheet amount indicator to the rotary shaft in the upside down manner, the sheet amount indicator can be used in common with a simple configuration.

[Aspect P]

In Aspects A through O, the sheet amount display end (for example, the sheet amount display end 34*a*) of the sheet amount indicator (for example, the sheet amount indicator 34) can be visually acknowledged through a display aperture (for example, the window 33) of the outer end part (for example, the outer end part 30).

Accordingly, as described in the above-described embodiments, the sheet amount display end of the sheet amount indicator can be seen through the display aperture of the outer end part, so that the remaining amount of sheets can be checked visually. Further, since the sheet amount display end of the sheet amount indicator is seen through the display aperture, a part or component other than the sheet amount display end is not exposed, thereby preventing damaging the sheet amount indicator.

[Aspect Q]

In Aspect P, the display aperture (for example, the window 33) of the outer end part (for example, the outer end part 30) has a sloped surface (for example, the window sloped portions 108) at an edge of the display aperture, extending wider from an inner side of the sheet container (for example, the sheet tray 1) toward an outer side thereof.

Accordingly, as described in the above-described embodiments, the sheet amount display end can easily be seen through the display aperture, thereby enhancing visibility of the remaining amount of sheets in the sheet feeding device.

[Aspect R]

In Aspects P or Q, the display aperture (for example, the window 33) of the outer end part (for example, the outer end part 30) includes a peripheral part (for example, the peripheral part 107) and a graduation (for example, the graduation 109) arranged on the peripheral part to show the remaining amount of sheets in the sheet container (for example, the sheet container 31).

Accordingly, as described in the above-described embodiments, the remaining amount of sheet in the sheet container can be grasped easily according to the relative position of the sheet amount display end (for example, the sheet amount display end 34*a*) and the graduation. By having a clear grasp of the remaining amount of sheets in the sheet container, acknowledgement of sheets remaining in the sheet feeding device can be enhanced.

[Aspect S]

According to Aspects P through R, a leading point of the sheet amount display end (for example, the sheet amount display end 34*a*) of the sheet amount indicator (for example, the sheet amount indicator 34) remains inside the display aperture (for example, the window 33) of the outer end part (for example, the outer end part 30).

Accordingly, as described in the above-described embodiments, by disposing the sheet amount display end inside the outer end part from an outer end surface (for example, the outer end surface 300), the sheet amount display end does not contact the display aperture by accident, thereby preventing damaging the sheet amount display end.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeding device comprising:

a sheet container that contains a sheet stack therein;

an outer end part that is detachably attached to the sheet container;

a sheet feeding member to feed the sheet in the sheet container to an outside of the sheet feeding device;

a swing shaft disposed at an upstream side of the sheet container in a sheet feeding direction;

a sheet loading member having a loading surface on which the sheet in the sheet container is loaded, and being supported by the swing shaft to swing according to an amount of sheets loaded on the loading surface;

multiple rotary shafts;

a sheet amount indicator being rotatably supported by one of the rotary shafts, having a contact end that contacts the sheet loading member swinging according to the amount of sheets loaded on the sheet loading member, and having a sheet amount display end disposed at an opposite side of the contact end with one of the rotary shafts in between and moving in a given display range visible from the outside of the sheet feeding device; and a rotary supporting part supported by a selected one of the multiple rotary shafts disposed at different positions.

2. The sheet feeding device according to claim 1, wherein an angle and direction of slope of the sloped surface with respect to the loading surface is set as the sheet amount display end of the sheet amount indicator moves a whole range of the given display amount between a sheet full state and a sheet empty state of the sheets on the sheet loading member.

3. The sheet feeding device according to claim 1, wherein the outer end part comprises an outer end surface having a display aperture in which the sheet amount display end is moved, wherein the sheet amount indicator is detachably attached to a corresponding one of the multiple rotary shafts.

4. The sheet feeding device according to claim 1, wherein the outer end part has a display aperture in which the sheet amount display end of the sheet amount indicator is moved, and is detachably attached to the sheet container, and wherein the sheet amount indicator includes multiple rotary shafts disposed both at the sheet container and the outer end part.

5. The sheet feeding device according to claim 1, wherein the sloped surface is integrally included with the sheet loading member.

6. The sheet feeding device according to claim 1, wherein the sloped surface projects from the sheet loading member to one of an upper side direction, a lower side direction, and an upper and lower side direction.

7. The sheet feeding device according to claim 1, wherein the sloped surface is disposed at a position not to interfere with the sheet on the sheet loading member.

8. The sheet feeding device according to claim 1, wherein the sheet amount indicator is an arm-shaped member having a bend.

9. The sheet feeding device according to claim 1, wherein the outer end part has an interfering part to interfere with attachment or movement of the sheet amount indicator when the sheet amount indicator is fitted to the rotary shaft other than a target rotary shaft.

10. The sheet feeding device according to claim 1, wherein the sheet amount indicator comprises a detecting part body member having the contact end and a display part body having the sheet amount display end to be detachably attached to each other, and wherein the rotary supporting part is supported by one of the rotary shafts and is included in either one of the detecting part body and the display part body.

11. The sheet feeding device according to claim 10, wherein the detector part body member and the display part body are connected to each other.

12. The sheet feeding device according to claim 1, wherein the sheet feeding device further comprises multiple supported parts disposed at different positions of the sheet amount indicator, wherein one of the multiple supported parts is supported by the rotary shaft of the sheet amount indicator.

13. The sheet feeding device according to claim 12, wherein the multiple supported parts of the sheet amount indicator have different shapes from each other, and wherein the sheet amount indicator includes multiple rotary shafts according to the respective shapes of the multiple supported parts.

14. The sheet feeding device according to claim 12, wherein the sheet amount indicator has multiple different contact ends, and wherein, when one of the multiple different supported parts of the sheet amount indicator is supported by the rotary shaft, one of the multiple different contact ends contacts the sheet loading member.

15. The sheet feeding device according to claim 1, wherein the sheet amount indicator has multiple different contact ends, wherein the sheet amount indicator is supported by the rotary shaft in one of a normal manner and an upside down manner, and wherein one of the multiple different contact end contacts the sheet loading member.

16. The sheet feeding device according to claim 1, wherein the outer end part comprises a display aperture through which the sheet amount display end of the sheet amount indicator is visually acknowledged.

17. The sheet feeding device according to claim 16, wherein the display aperture of the outer end part has a sloped surface at an edge of the display aperture, extending wider from an inner side of the sheet container toward an outer side thereof.

18. The sheet feeding device according to claim 16, wherein the display aperture of the outer end part includes a peripheral part and a graduation arranged on the peripheral part to show a remaining amount of sheets in the sheet container.

19. The sheet feeding device according to claim 16, wherein a leading point of the sheet amount display end of the sheet amount indicator remains inside the display aperture of the outer end part.

20. An image forming apparatus comprising:

an image carrier to form an image on a surface thereof; and the sheet feeding device according to claim 1 to feed a sheet onto which the image is transferred.

21. The sheet feeding device according to claim 1, wherein the sheet loading member has a sloped surface sloped with respect to the loading surface and disposed at a portion where the contact end of the sheet amount indicator contacts the loading surface.

22. The sheet feeding device according to claim 1, wherein the rotary supporting part is rotatably supported to the support shaft attached to the outer end part.

23. The sheet feeding device according to claim 1, wherein the rotary supporting part is rotatably supported to the support shaft attached to the sheet container.

* * * * *